US011446562B2

(12) United States Patent
Desberg

(10) Patent No.: US 11,446,562 B2
(45) Date of Patent: Sep. 20, 2022

(54) CASTER BOARDS WITH REMOVABLE INSERT

(71) Applicant: Razor USA LLC, Cerritos, CA (US)

(72) Inventor: Ian Desberg, Cerritos, CA (US)

(73) Assignee: Razor USA LLC, Cerritos, CA (US)

( * ) Notice: Subject to any disclaimer, the term of this patent is extended or adjusted under 35 U.S.C. 154(b) by 0 days.

(21) Appl. No.: 17/025,588

(22) Filed: Sep. 18, 2020

(65) Prior Publication Data

US 2021/0077892 A1 Mar. 18, 2021

Related U.S. Application Data

(60) Provisional application No. 62/902,241, filed on Sep. 18, 2019.

(51) Int. Cl.

| | |
|---|---|
| ***A63C 17/00*** | (2006.01) |
| ***A63C 17/01*** | (2006.01) |
| ***A63C 17/22*** | (2006.01) |
| ***A63C 17/26*** | (2006.01) |

(52) U.S. Cl.

CPC ..... *A63C 17/0033* (2013.01); *A63C 17/014* (2013.01); *A63C 17/226* (2013.01); *A63C 17/26* (2013.01)

(58) Field of Classification Search

CPC ..... A63C 17/016

See application file for complete search history.

(56) References Cited

U.S. PATENT DOCUMENTS

| | | | |
|---|---|---|---|
| 2,051,762 | A | 8/1936 | Vincent |
| 3,288,251 | A | 11/1966 | Paul |
| 3,399,904 | A | 9/1968 | Schinke |
| 3,399,906 | A | 9/1968 | Portnoff |
| 3,771,811 | A | 11/1973 | Bueno |
| 3,982,766 | A | 9/1976 | Budge |
| D243,206 | S | 1/1977 | Sherwood |
| 4,037,852 | A | 7/1977 | Bayer et al. |
| D246,065 | S | 10/1977 | Saul |
| 4,060,253 | A | 11/1977 | Oldendorf |

(Continued)

FOREIGN PATENT DOCUMENTS

| | | |
|---|---|---|
| AU | 2007214338 | 3/2007 |
| CA | 2596570 | 10/2007 |

(Continued)

OTHER PUBLICATIONS

"About: Skateboarding; Other Boardsports", http://skateboard.about.com/cs/fringeboarding/gr/?once-true&; Mar. 2007, in 2 pages.

(Continued)

*Primary Examiner* — Brian L Swenson

(74) *Attorney, Agent, or Firm* — Knobbe, Martens, Olson & Bear, LLP

(57) ABSTRACT

A caster board can include a front platform, a rear platform, and at least two neck sections extending between the front platform and the rear platform. The neck sections can serve as a torsion element allowing twisting of the front platform relative to the rear platform. An aperture between the neck sections can be configured to receive an insert. The insert can alter a structural characteristic of the caster board, such as the torsional stiffness of the caster board.

19 Claims, 18 Drawing Sheets

(56) References Cited

U.S. PATENT DOCUMENTS 4,076,267 A 2/1978 Lipscomb
4,082,306 A 4/1978 Sheldon
4,092,033 A 5/1978 Swain
4,093,252 A 6/1978 Rue
D250,492 S 12/1978 Kish
4,140,326 A 2/1979 Huber
4,245,848 A 1/1981 Dudouyt
4,295,656 A 10/1981 Moore
4,359,231 A 11/1982 Mulcahy
4,411,442 A 10/1983 Rills
4,451,055 A 5/1984 Lee
4,458,907 A 7/1984 Meredith
4,902,256 A 2/1990 Berglund
4,915,403 A 4/1990 Wild
4,921,513 A 5/1990 Parten
4,930,794 A 6/1990 Chan
4,930,924 A 6/1990 Hunt
4,955,626 A 9/1990 Smith
5,067,058 A 11/1991 Standley
5,098,087 A 3/1992 Matile
5,160,155 A 11/1992 Barachet
5,267,743 A 12/1993 Smisek
D345,406 S 3/1994 Shankland
D346,418 S 4/1994 Fischbach
5,330,026 A 7/1994 Hsu et al.
5,347,681 A 9/1994 Wattron et al.
5,419,570 A 5/1995 Bollotte
5,458,351 A 10/1995 Yu
5,460,558 A 10/1995 Woodstock
5,492,345 A 2/1996 Kruczek
5,505,474 A 4/1996 Yeh
5,529,523 A 6/1996 Wilhelmi
5,540,455 A 7/1996 Chambers
5,549,331 A 8/1996 Yun
5,566,956 A 10/1996 Wang
5,601,299 A 2/1997 Yun
5,622,759 A 4/1997 Fuster
5,707,068 A 1/1998 Bradfield
5,766,051 A 6/1998 Messer
5,826,895 A 10/1998 Bradfield
5,853,182 A 12/1998 Finkle
5,855,385 A 1/1999 Hambsch
5,884,983 A 3/1999 Wu
5,893,425 A 4/1999 Finkle
D410,515 S 6/1999 Alexander
5,910,035 A 6/1999 Rebotier et al.
D413,954 S 9/1999 Gerlach
5,984,328 A 11/1999 Tipton
D422,661 S 4/2000 Edwards et al.
D422,662 S 4/2000 Edwards et al.
6,050,357 A 4/2000 Staelin
6,056,302 A 5/2000 Smith
6,059,303 A 5/2000 Bradfield
6,102,415 A 8/2000 Stewardson
6,106,347 A 8/2000 Harness
6,193,249 B1 2/2001 Buscaglia
6,206,389 B1 3/2001 Yagi
6,254,113 B1 7/2001 Dornan
6,293,565 B1 9/2001 Bouchard et al.
6,315,304 B1 11/2001 Kirkland et al.
6,328,328 B1 12/2001 Finiel
6,338,494 B1 1/2002 Killian
D455,186 S 4/2002 Koester
D456,047 S 4/2002 Mandic
6,398,237 B1 6/2002 Attey
6,419,248 B1 7/2002 Kay
6,419,249 B1 7/2002 Chen
6,428,022 B1 8/2002 Namiki
6,440,526 B1 8/2002 Gamble et al.
6,481,724 B1 11/2002 Whipp
6,485,044 B1 11/2002 Blake
6,494,467 B1 12/2002 Menges
6,502,850 B1 1/2003 Schaller et al.
6,572,130 B2 6/2003 Greene et al.
6,669,215 B2 12/2003 Laporte
6,808,196 B2 10/2004 Des Ouches
6,863,292 B1 3/2005 Paasch et al.
D503,763 S 4/2005 Morgan
D506,427 S 6/2005 Weber
6,910,698 B2 6/2005 Turner et al.
6,976,687 B2 12/2005 Beleki, Jr.
6,979,006 B2 12/2005 Pierron
7,044,486 B2 5/2006 Wright
7,053,289 B2 5/2006 Iwai et al.
7,083,178 B2 8/2006 Potter
7,093,842 B2 8/2006 Potter
7,182,360 B2 2/2007 Paasch et al.
7,195,259 B2 3/2007 Gang
7,198,280 B2 4/2007 Hara
7,213,823 B1 5/2007 Vujtech
7,252,625 B1 8/2007 Perka
D552,201 S 10/2007 Kwak
D556,283 S 11/2007 Hamborg et al.
7,316,597 B2 1/2008 Skedeleski
D561,289 S 2/2008 Stanisewski
7,325,819 B2 2/2008 Kwak
D564,613 S 3/2008 Hamborg
7,338,056 B2 3/2008 Chen et al.
7,367,572 B2 5/2008 Jiang
D572,332 S 7/2008 Sramek et al.
D577,789 S 9/2008 Mazur
7,600,768 B2 10/2009 Chen
D607,521 S 1/2010 Chables et al.
D607,524 S 1/2010 Marciano
D608,851 S 1/2010 Hillman
D614,714 S 4/2010 Walworth
7,766,351 B2 8/2010 Chen et al.
7,775,534 B2 8/2010 Chen et al.
D623,701 S 9/2010 Dalgaard
D623,702 S 9/2010 Dalgaard et al.
7,867,050 B2 1/2011 Crispin
7,891,680 B2 2/2011 Chen et al.
D638,494 S 5/2011 Scolari et al.
8,047,556 B2 11/2011 Jang et al.
8,061,725 B1 11/2011 Hawkins
8,118,319 B2 2/2012 Hsieh
D655,772 S 3/2012 Bin
8,157,274 B2 4/2012 Chen
D673,233 S 12/2012 Baggett
8,360,475 B2 1/2013 Cristiano
8,408,565 B2 4/2013 An
8,414,000 B2 4/2013 Chen
8,469,376 B2 6/2013 Kristiansen
D692,079 S 10/2013 Mackay
D692,080 S 10/2013 Hamborg et al.
8,632,084 B2 1/2014 Lovley, II et al.
D698,881 S 2/2014 Hamborg
D699,803 S 2/2014 Yamabe
D705,372 S 5/2014 Harris
8,720,916 B2 5/2014 Bermal
8,857,831 B1 10/2014 Rotondo
8,864,152 B1 * 10/2014 Danze ..... B62K 3/002 280/87.041
8,915,506 B2 12/2014 Piaceski et al.
D724,166 S 3/2015 Hamborg et al.
D728,048 S 4/2015 Stover
9,010,778 B1 * 4/2015 Burns ..... A63C 17/016 280/87.042
D739,906 S 9/2015 Chen
9,186,570 B1 11/2015 Wells
9,302,173 B2 4/2016 DiCarlo
9,393,481 B2 7/2016 Fournier
D770,585 S 11/2016 Desberg
9,492,731 B2 11/2016 Marusiak et al.
D785,115 S 4/2017 Ying
D790,015 S 6/2017 Tan
9,682,309 B2 6/2017 Huang
D792,931 S 7/2017 Desberg
9,975,035 B1 5/2018 Wang
10,022,615 B2 7/2018 Huang
10,022,616 B1 7/2018 Consol
D827,748 S 9/2018 Desberg
D829,838 S 10/2018 Huang
D865,096 S 10/2019 Desberg

(56) References Cited

U.S. PATENT DOCUMENTS

| | | | | |
|---|---|---|---|---|
| D871,532 | S | 12/2019 | Huang | |
| 10,625,830 | B2 | 4/2020 | Lenchner et al. | |
| 10,709,960 | B2 | 7/2020 | Huang | |
| 10,787,218 | B2 | 9/2020 | Wen | |
| D899,543 | S | 10/2020 | Desberg | |
| D911,476 | S | 2/2021 | Huang | |
| 2002/0043774 | A1 | 4/2002 | Chou | |
| 2002/0067015 | A1 | 6/2002 | Tierney et al. | |
| 2002/0149166 | A1 | 10/2002 | Potter | |
| 2002/0195788 | A1 | 12/2002 | Tierney et al. | |
| 2003/0124923 | A1 | 7/2003 | Mercer | |
| 2003/0155725 | A1 | 8/2003 | Roderick | |
| 2003/0155733 | A1 | 8/2003 | Tan et al. | |
| 2004/0021281 | A1 | 2/2004 | Stephens | |
| 2004/0144582 | A1 | 7/2004 | Baker et al. | |
| 2004/0163867 | A1 | 8/2004 | Hillman | |
| 2004/0212160 | A1 | 10/2004 | Roderick | |
| 2004/0262872 | A1 | 12/2004 | Kang | |
| 2006/0032682 | A1 | 2/2006 | Hillman | |
| 2006/0032685 | A1 | 2/2006 | Koide | |
| 2006/0038361 | A1 | 2/2006 | Sano | |
| 2006/0049595 | A1 | 3/2006 | Crigler | |
| 2006/0055135 | A1 | 3/2006 | Tracewell et al. | |
| 2006/0055137 | A1 | 3/2006 | Jiang | |
| 2006/0163830 | A1 | 7/2006 | Kwak | |
| 2007/0001414 | A1 | 1/2007 | Kang | |
| 2007/0035102 | A1 | 2/2007 | McClain | |
| 2007/0132199 | A1 | 6/2007 | Smith | |
| 2007/0252355 | A1 | 11/2007 | Chen et al. | |
| 2007/0257459 | A1 | 11/2007 | Gang | |
| 2007/0272465 | A1 | 11/2007 | Su | |
| 2007/0273118 | A1 | 11/2007 | Conrad | |
| 2007/0296164 | A1 | 12/2007 | Roderick | |
| 2009/0045598 | A1 | 2/2009 | Lee | |
| 2009/0058028 | A1 | 3/2009 | Chen | |
| 2009/0134591 | A1 | 5/2009 | Chen et al. | |
| 2009/0270002 | A1 | 10/2009 | Crispin | |
| 2009/0295111 | A1 | 12/2009 | O'Rourke | |
| 2010/0225080 | A1 | 9/2010 | Smith | |
| 2010/0253027 | A1 | 10/2010 | Chen et al. | |
| 2011/0006497 | A1* | 1/2011 | Chen | A63C 17/012 280/87.042 |
| 2011/0037238 | A1 | 2/2011 | Devine | |
| 2011/0187069 | A1 | 8/2011 | Marcel | |
| 2012/0007331 | A1* | 1/2012 | Hsieh | A63C 17/017 280/221 |
| 2012/0187648 | A1 | 7/2012 | Chen | |
| 2013/0001910 | A1 | 1/2013 | Hsu | |
| 2013/0168936 | A1 | 7/2013 | Morita | |
| 2013/0277939 | A1* | 10/2013 | Yamabe | A63C 17/012 280/200 |
| 2014/0210175 | A1 | 7/2014 | Hsu | |
| 2016/0332062 | A1 | 11/2016 | Wu et al. | |
| 2017/0151489 | A1 | 6/2017 | Kim | |
| 2018/0296907 | A1 | 10/2018 | Huang | |
| 2018/0361226 | A1* | 12/2018 | Cho | A63C 17/12 |
| 2019/0070486 | A1 | 3/2019 | Shi | |
| 2020/0282296 | A1 | 9/2020 | Chen et al. | |
| 2020/0346099 | A1 | 11/2020 | Li | |
| 2021/0077894 | A1 | 3/2021 | Huang | |

FOREIGN PATENT DOCUMENTS

| | | | |
|---|---|---|---|
| CN | 101309730 | | 11/2008 |
| CN | 201205442 | | 3/2009 |
| CN | 206183946 | | 5/2017 |
| CN | 207157383 | U | 3/2018 |
| DE | 202008012754 | | 1/2009 |
| DK | 176806 | | 10/2009 |
| EP | 1511541 | | 3/2005 |
| EP | 1679101 | | 7/2006 |
| GB | 2318519 | | 4/1998 |
| GB | 2464676 | | 4/2010 |
| JP | H0l-117385 | U | 8/1989 |
| JP | 10-211313 | | 8/1998 |
| JP | 2000-500369 | | 1/2000 |
| JP | 2001-029663 | | 2/2001 |
| JP | A 2002-502743 | | 1/2002 |
| JP | 2005-537820 | | 12/2005 |
| JP | A 2008-545480 | | 12/2008 |
| JP | A 2015-527908 | | 9/2015 |
| KR | 10 20050060368 | | 6/2005 |
| KR | 200 400 315 | Y1 | 11/2005 |
| KR | 200 410 530 | Y1 | 3/2006 |
| KR | 10-0921839 | | 10/2009 |
| KR | 10-20010110239 | | 12/2011 |
| SU | 1405865 | | 4/1986 |
| TW | 247446 | | 5/1995 |
| TW | 266104 | | 12/1995 |
| WO | WO 1993/01870 | A1 | 2/1993 |
| WO | WO 1997/018865 | | 5/1997 |
| WO | WO 1999/39787 | | 8/1999 |
| WO | WO 2002/040116 | | 5/2002 |
| WO | WO 2003/092831 | | 11/2003 |
| WO | WO 2004/105901 | A1 | 12/2004 |
| WO | WO 2006/022472 | | 3/2006 |
| WO | WO 2007/102645 | | 9/2007 |
| WO | WO 2007/111466 | | 10/2007 |
| WO | WO 2007/117092 | | 10/2007 |
| WO | WO 2007/127554 | | 11/2007 |
| WO | WO 2007/139356 | | 12/2007 |
| WO | WO 2009/036074 | | 3/2009 |
| WO | WO 2009/100722 | | 8/2009 |
| WO | WO 2010/019627 | | 2/2010 |
| WO | WO 2012/083950 | | 6/2012 |
| WO | WO 2014/009760 | | 1/2014 |
| WO | WO 2016/086066 | | 6/2016 |
| WO | WO 2018/195103 | | 10/2018 |
| WO | WO 2020/181093 | | 9/2020 |
| WO | WO 2021/055852 | | 3/2021 |

OTHER PUBLICATIONS

About: Skateboarding; The Wave http://skateboard.about.com/cs/fringeboarding/gr/XBoard.html; Jan. 2007, in 2 pages.

Micelle' Electric Wave Board [XinCheJian], URL- http://xinchejian.com/2011/05/07/miclles-electric-wave-board/; May 2011, in 6 pages.

The Wave, Streetsurfing, http://www.streetsurfing.com/wave/skating.html; Mar. 2007, in 2 pages.

International Search Report and Written Opinion in International Application No. PCT/US2020/051632, dated Dec. 11, 2020 in 13 pages.

* cited by examiner

CASTER BOARDS WITH REMOVABLE INSERT

CROSS-REFERENCE

This application claims the priority benefit of U.S. Provisional Patent Application No. 62/902,241, filed Sep. 18, 2019, the entirety of which is incorporated by reference herein. Additionally, all applications for which a foreign or domestic priority claim is identified in the Application Data Sheet as filed with the present application are hereby incorporated by reference under 37 CFR 1.57.

BACKGROUND

Field of the Disclosure

This disclosure relates generally to wheeled vehicles, such as caster boards that include platforms connected by a split neck region having a first section, a second section, and an aperture therebetween. The aperture can removably receive an insert, which can provide additional functionality and/or change the vehicle's riding characteristics.

Description of Certain Related Art

Some caster boards are two-wheeled vehicles that includes a deck with two platforms that are connected by torsion bar and/or a neck region of the platform. The neck region and/or torsion bar can function as a torsion element and may be configured to resiliently twist along a longitudinal axis of the vehicle. One or more wheels can be attached to each platform. The wheels can be a caster wheels. A rider can stand on the deck and obtain locomotion by pivoting the front and rear platforms relative to each other with a twisting motion.

SUMMARY OF CERTAIN FEATURES

In one broad aspect, a caster board assembly is provided, comprising a caster board comprising a front end, a rear end, and a neck between the front end and the rear end, the neck comprising a gap; and an insert configured to be removably positioned in the gap.

The insert may be configured to modify a structural property of the caster board. The insert may be configured to alter the torsional stiffness of the caster board. The insert is configured to add mass to the caster board. The insert may be configured to redistribute or control the distribution of mass across the caster board.

The gap may include a through-hole extending through the neck. The gap may include a blind hole extending partway through the neck. The gap may include a chamfered section adjacent an upper surface of the caster board.

The insert may include an electronic device. The insert may include an image and/or audio capture device. The insert may include a lighting element. The insert may include a security device. The insert may include a mounting device. The insert may include a wireless communication module. The insert may be configured to communicate with a separate device to receive control information and/or to transmit data. The insert may include an adapter configured to provide a secondary aperture with different dimensions than the aperture.

In another broad aspect, a caster board is provided, comprising: a platform, the platform comprising: a front platform section; a rear platform section; a first neck section extending between the front platform section and the rear platform section; and a second neck section extending between the front platform section and the rear platform section, the first neck section extending at an oblique angle to the second neck section; a first caster assembly connected to the first platform section; and a second caster assembly connected to the second platform section.

The oblique angle may be at least 2°. The oblique angle may be between 2° and 3°. The oblique angle may be between 1° and 5°. The oblique angle may be less than 25°, less than 20°, less than 15°, less than 10°, or less than 5°.

The caster board may additionally include an aperture extending through at least a portion of the platform, the aperture located between the first neck section and the second neck section. The aperture may be longitudinally asymmetric. The aperture may be vertically asymmetric. A distance between the first and second neck sections adjacent the rear platform section may be shorter than a distance between the first and second neck sections adjacent the front platform section.

The first and second neck sections may be located on opposite sides of a longitudinal axis of the caster board. The platform may be configured to twist about the longitudinal axis of the caster board, and a torsional stiffness of the first and second neck sections may be less than a torsional stiffness of the front platform section and less than a torsional stiffness of the rear platform section.

In another broad aspect, a caster board is provided, comprising: a front platform section; a rear platform section; a longitudinally tapering neck section extending between the front platform section and the rear platform section, a portion of the longitudinally tapering neck section adjacent the front platform section being wider than a portion of the longitudinally tapering neck section adjacent the rear platform section; and an aperture extending through at least a portion of the longitudinally tapering neck section.

The neck section may include two substantially linear neck portions extending on either side of the aperture. The portions of the substantially linear neck portions extending adjacent the aperture may have a substantially constant upper profile along their length.

The caster board may further include an insert retained within the aperture. The aperture may include a chamfered section and the insert may include a flared cross-sectional shape. The insert may be configured to increase a torsional stiffness of the longitudinally tapering neck section. The insert may include an electronic device configured to record at least one of video, images, or audio.

A width of the aperture may increase with increasing distance from the rear platform section.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise.

DETAILED DESCRIPTION OF CERTAIN EMBODIMENTS

Figure 1:
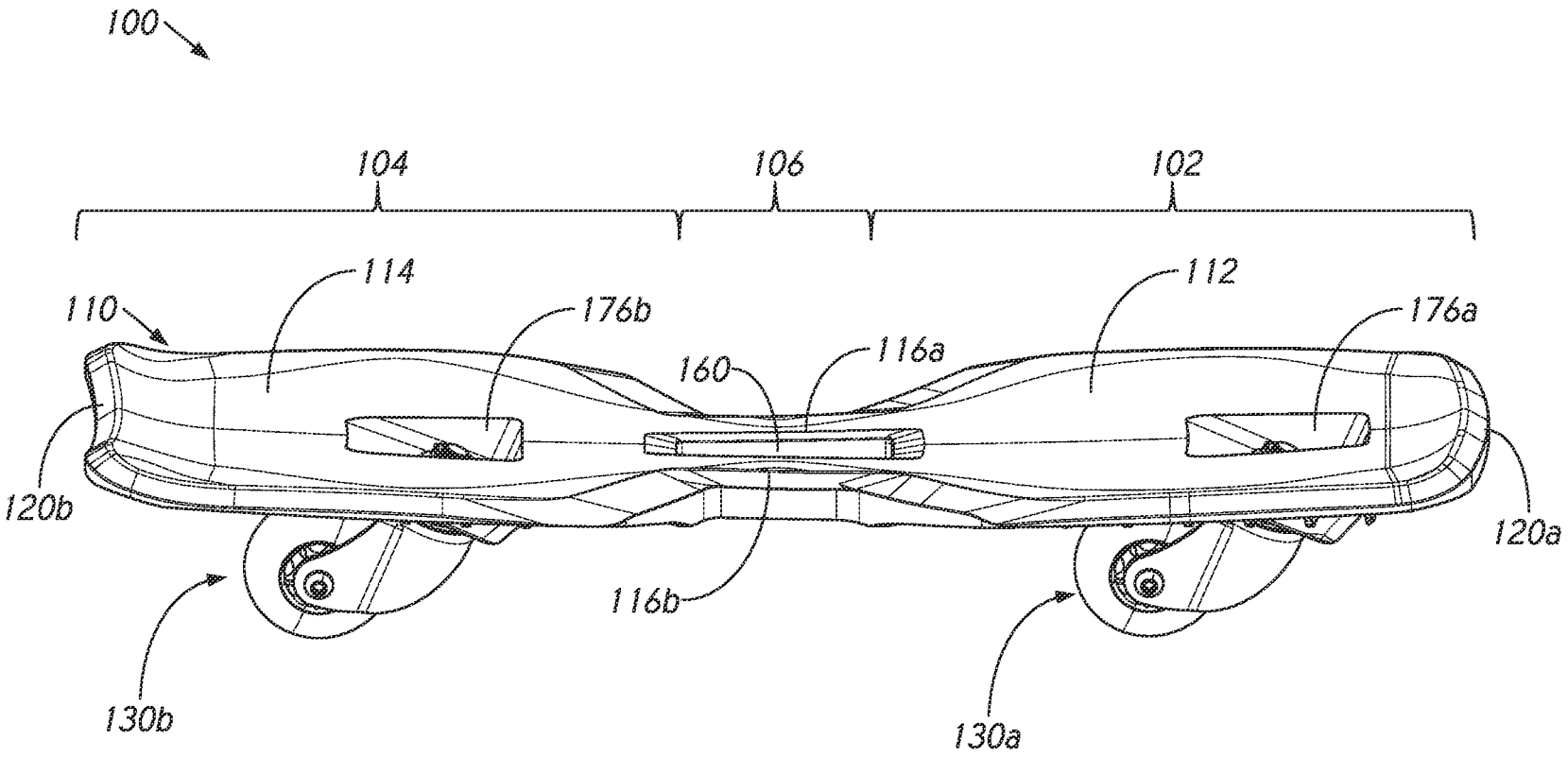
FIG. 1 is a side perspective view of an embodiment of a caster board having including a split neck region and an aperture, showing the caster board from the side and above.
Figure 2:
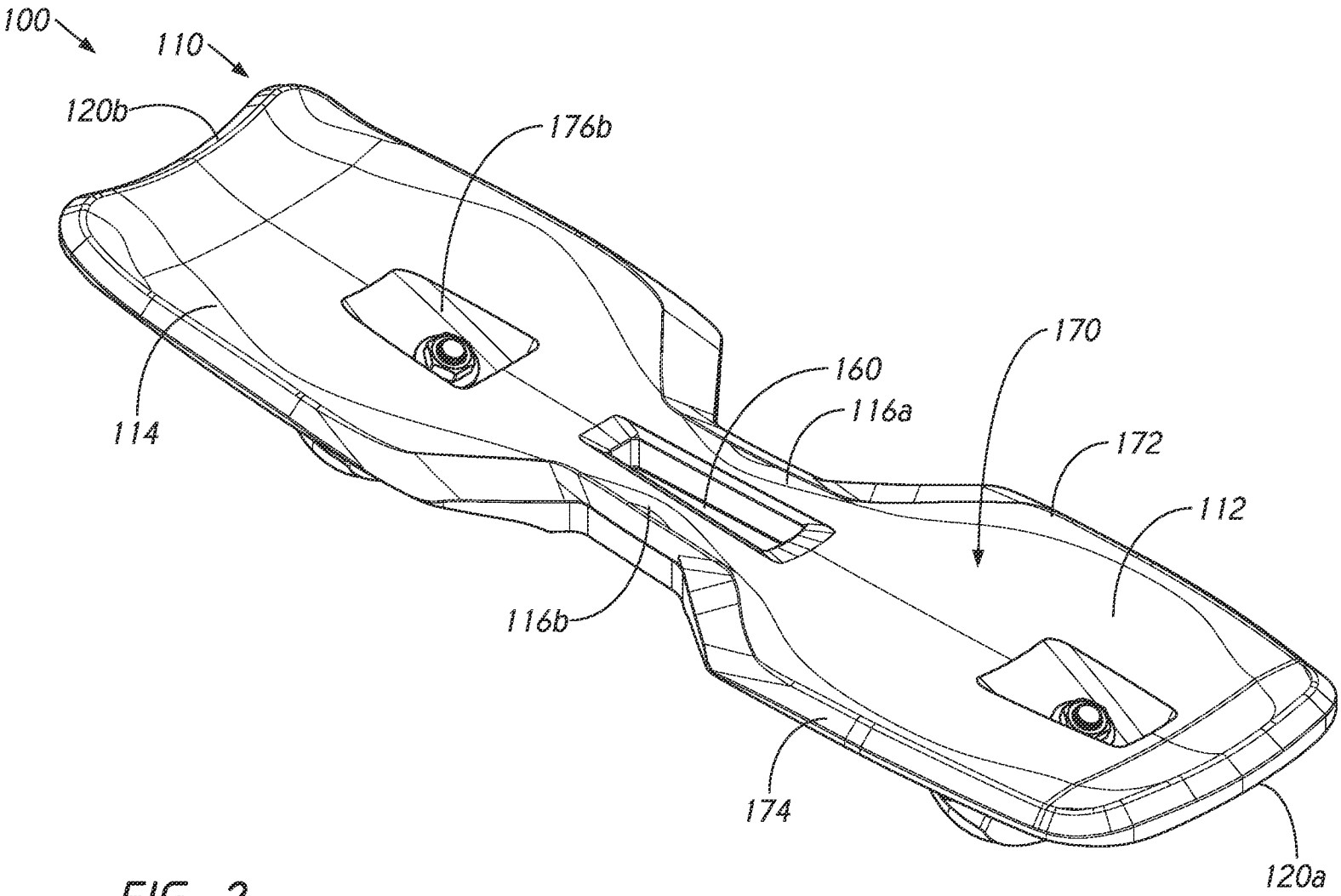
FIG. 2 is a front side perspective view of the caster board of FIG. 1, seen from the front, side and above.
Figure 3:
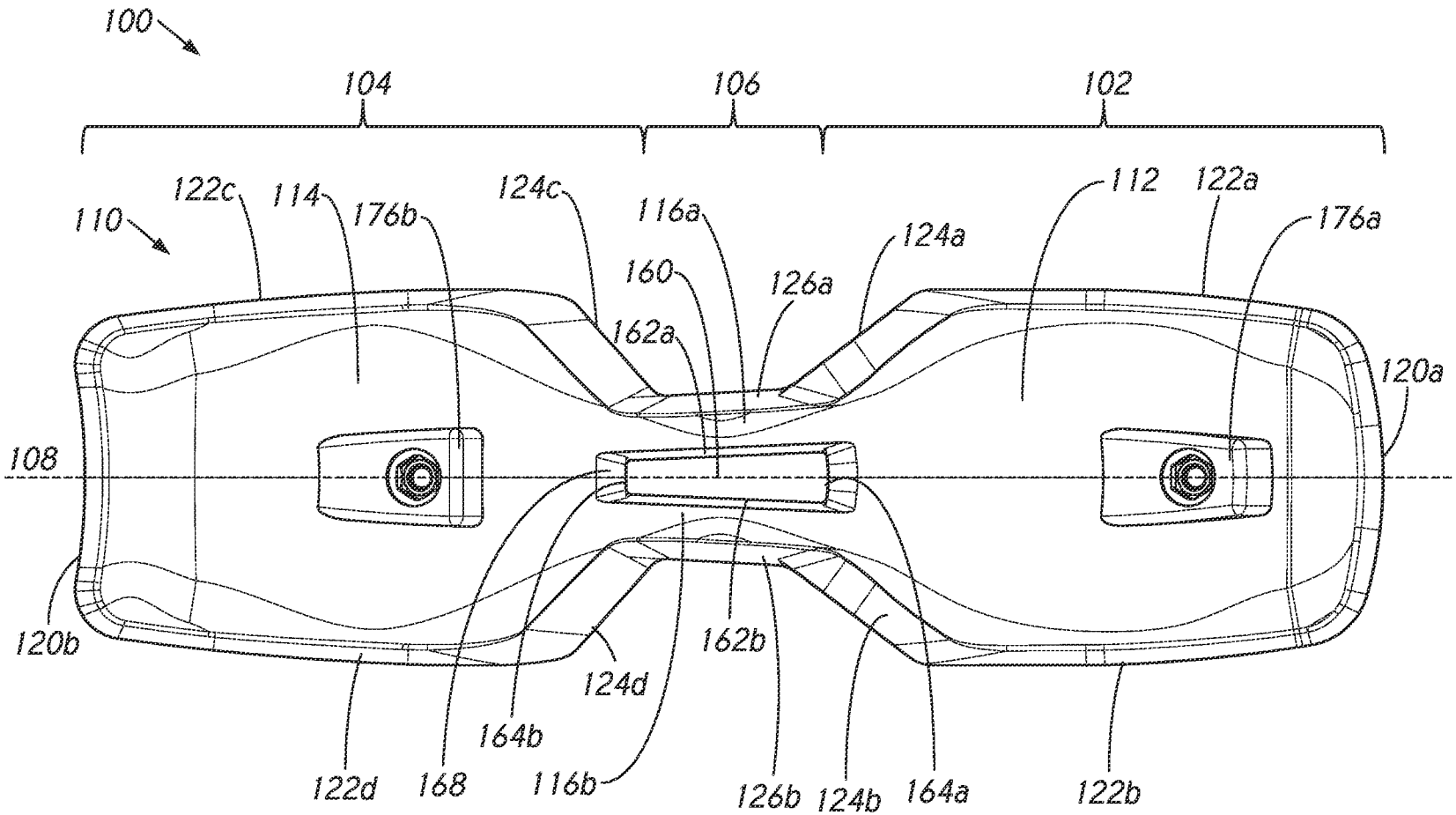
FIG. 3 is a top plan view of the caster board of FIG. 1.
Figure 4:
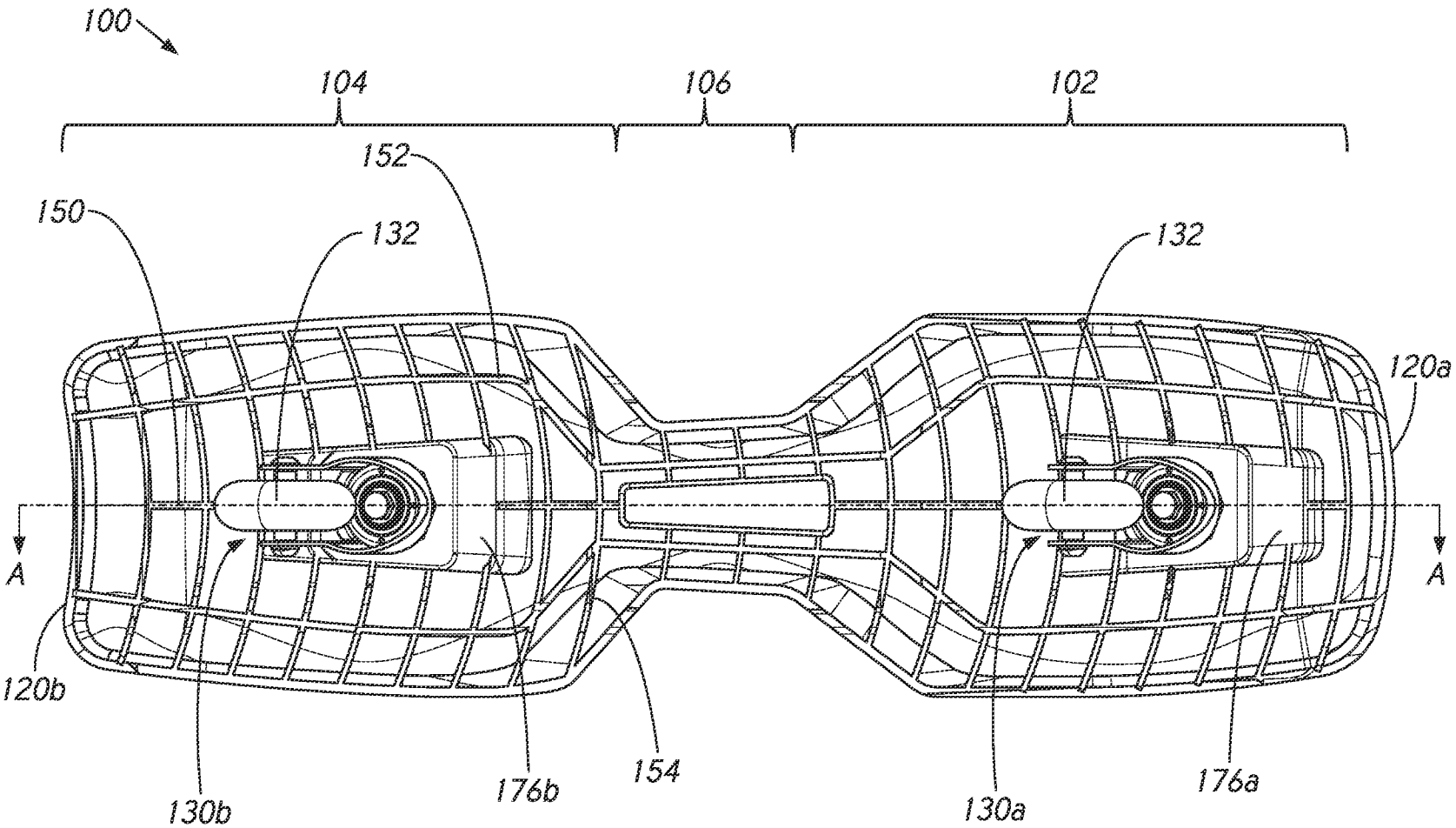
FIG. 4 is a bottom plan view of the caster board of FIG. 1.
Figure 5:
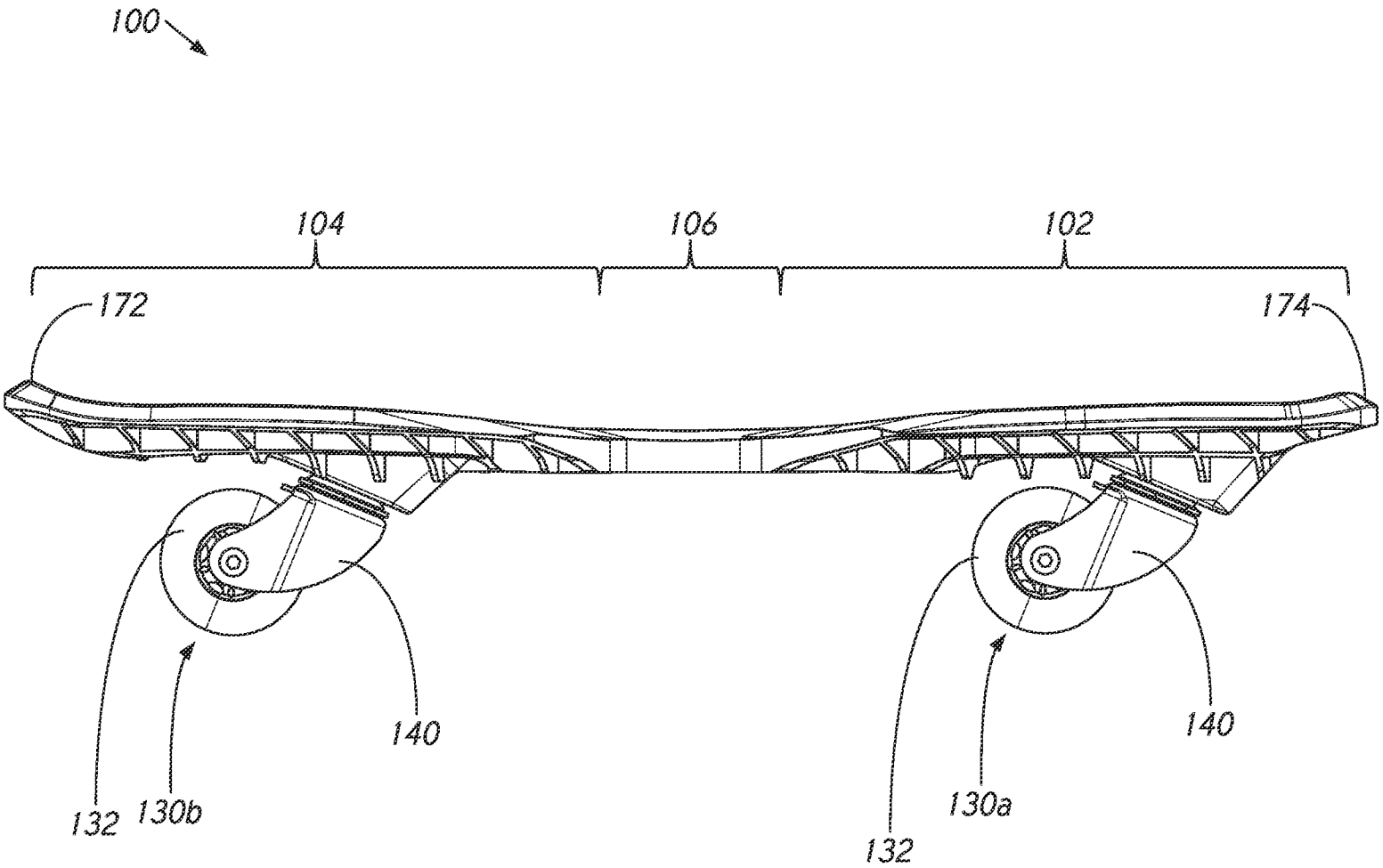
FIG. 5 is a right side view of the caster board of FIG. 1; the left side view being a mirror image thereof.
Figure 6:
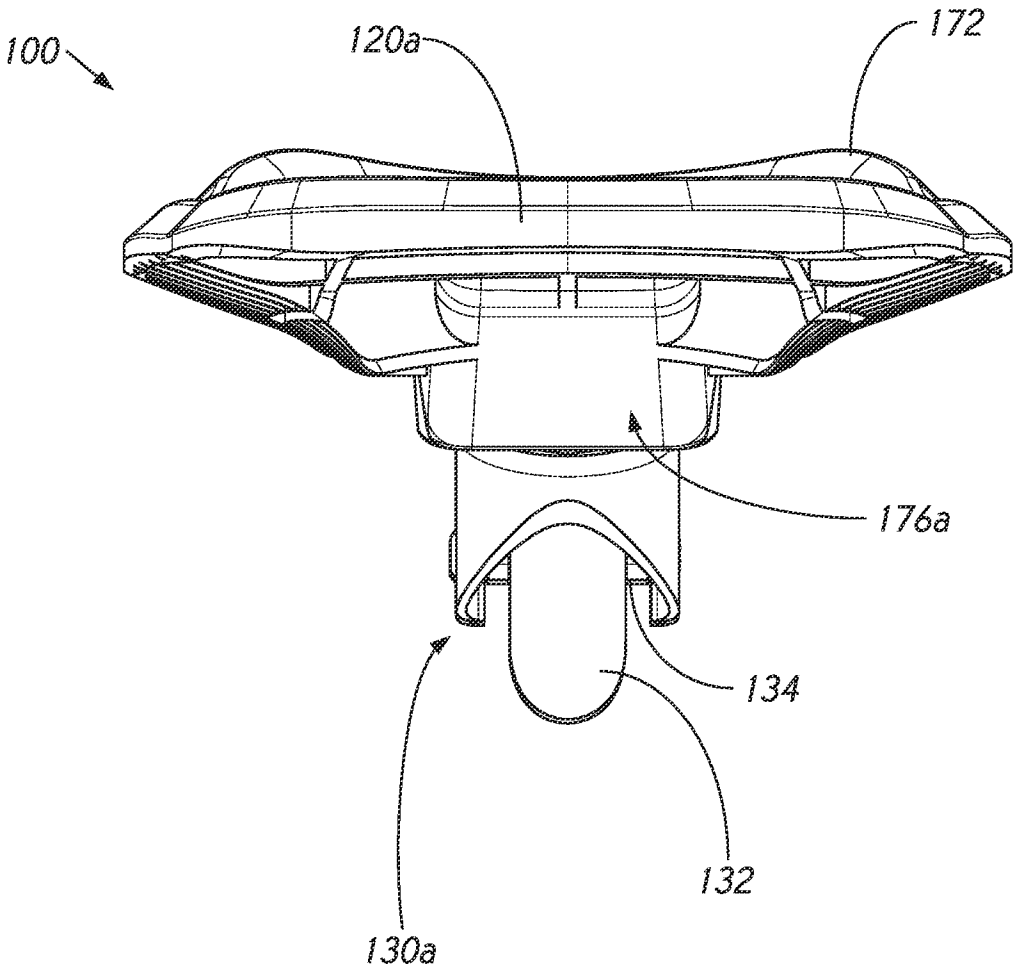
FIG. 6 is a front view of the caster board of FIG. 1.
Figure 7:
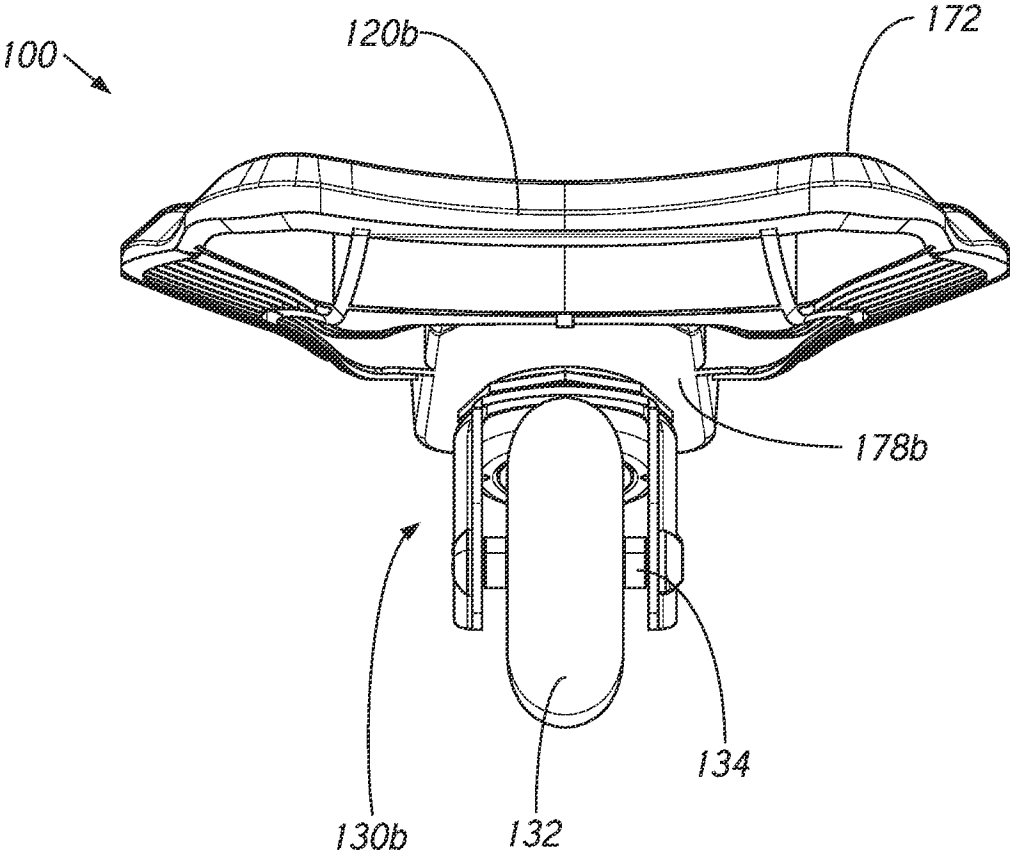
FIG. 7 is a rear view of the caster board of FIG. 1.
Figure 8:
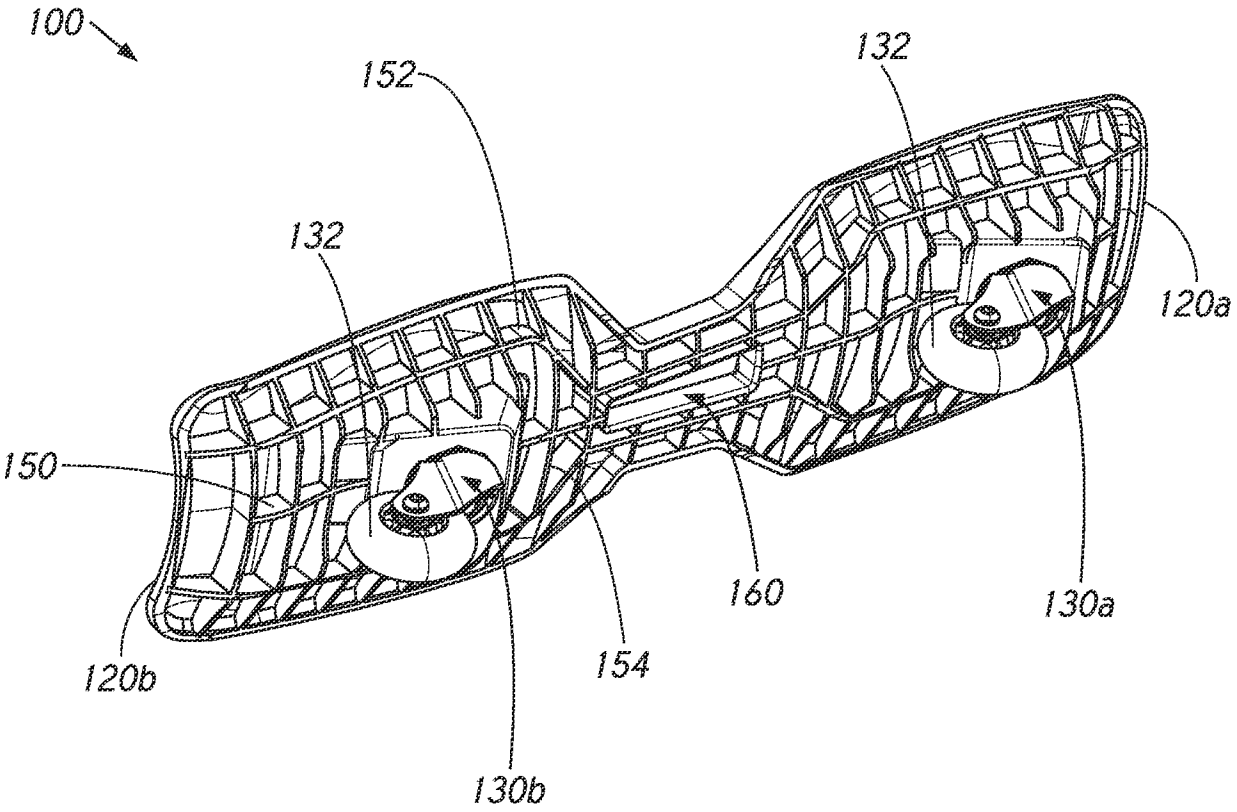
FIG. 8 is a rear side perspective view of the caster board of FIG. 1, seen from the back, side and below.
Figure 9:
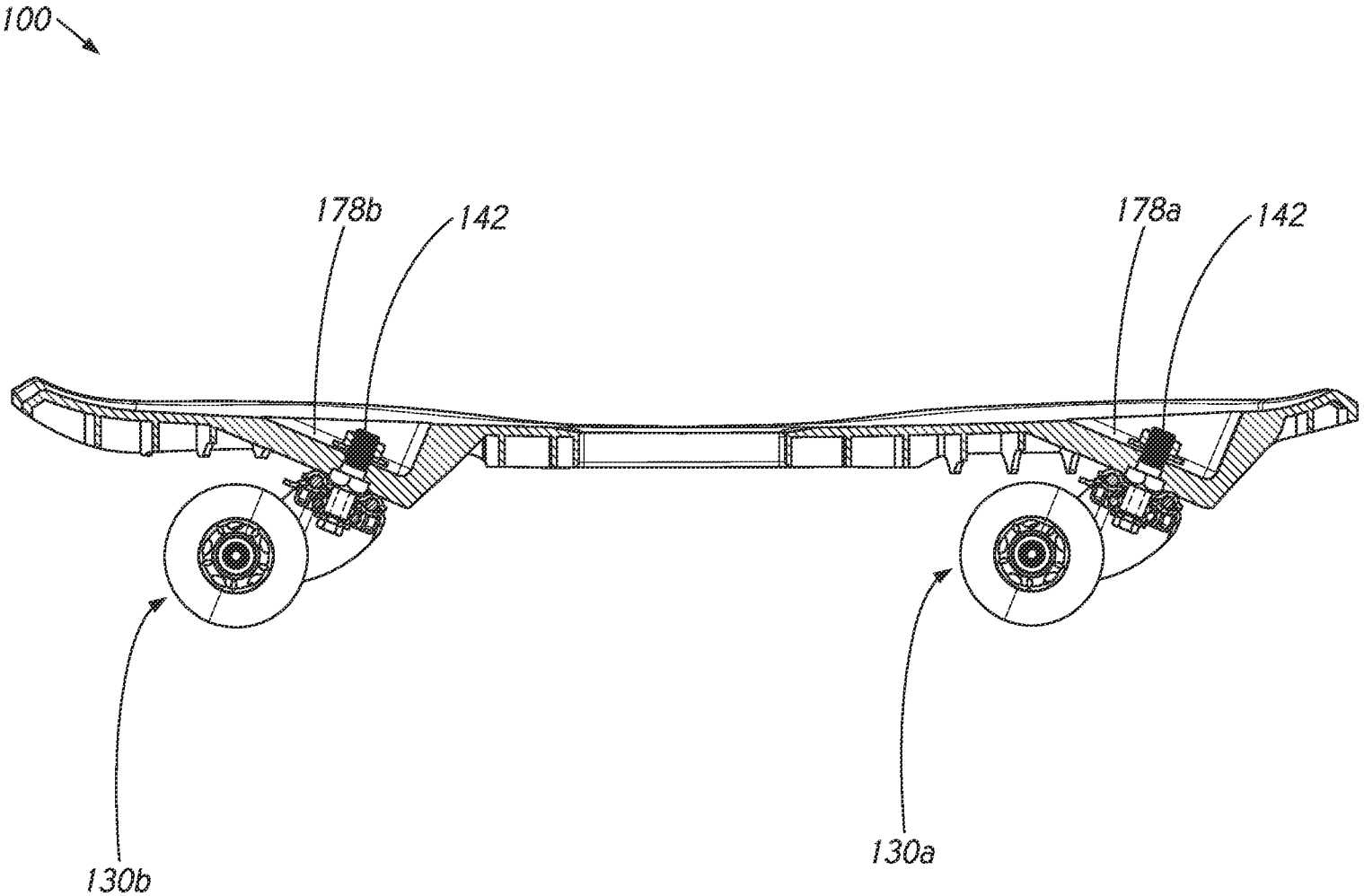
FIG. 9 is a cross-sectional view of the caster board of FIG. 1, taken along the line A-A of FIG. 4.
Figure 10:
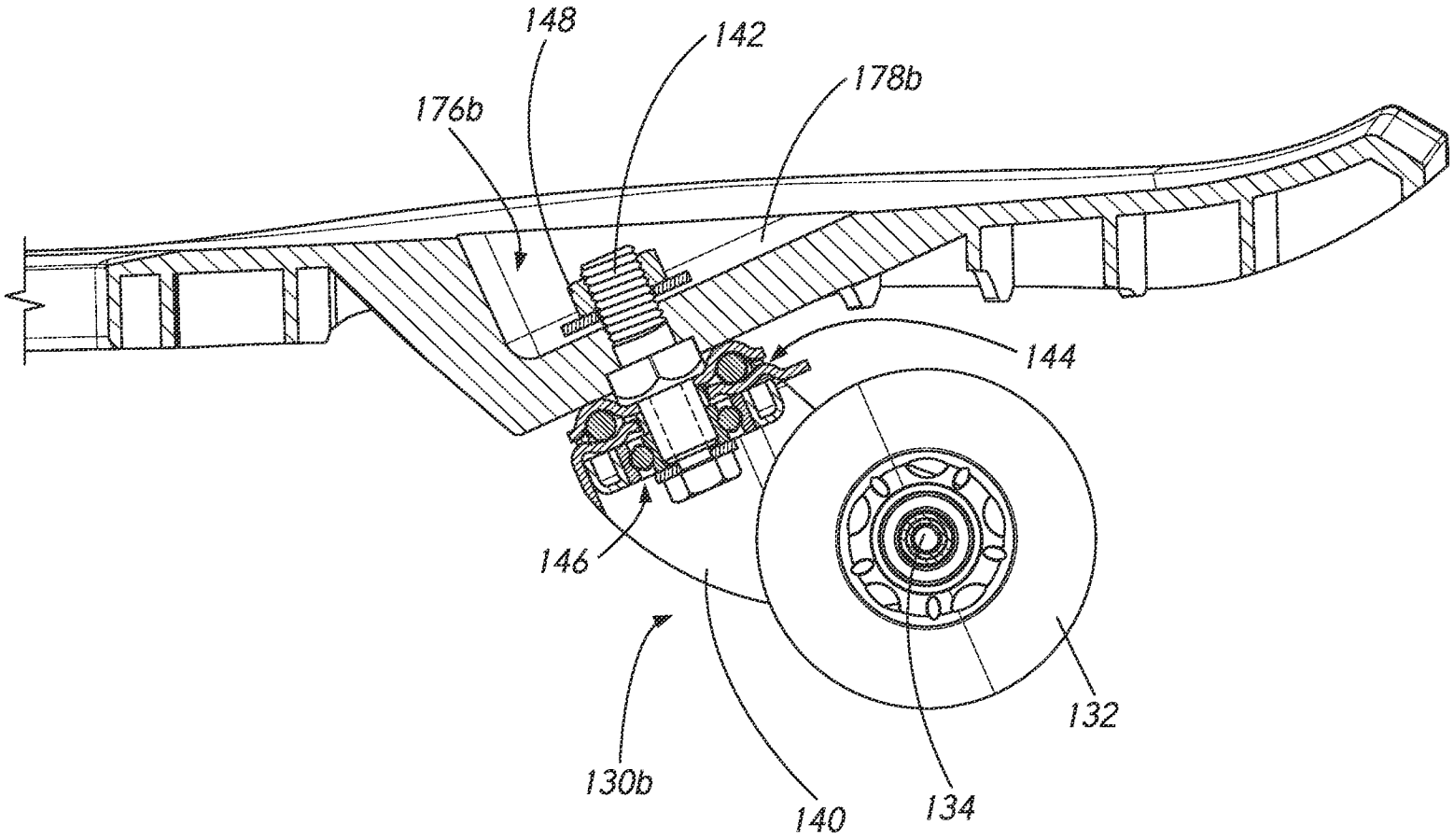
FIG. 10 is a detail cross-sectional view of a portion of the caster board of FIG. 1.

FIG. 1 is a side perspective view of an embodiment of a caster board, showing the caster board from the side and above. FIG. 2 is a front side perspective view of the caster board of FIG. 1, seen from the front, side and above. FIG. 3 is a top plan view of the caster board of FIG. 1. FIG. 4 is a bottom plan view of the caster board of FIG. 1. FIG. 5 is a side view of the caster board of FIG. 1. FIG. 6 is a front view of the caster board of FIG. 1. FIG. 7 is a rear view of the caster board of FIG. 1. FIG. 8 is a rear side perspective view of the caster board of FIG. 1, seen from the back, side and below. FIG. 9 is a cross-sectional view of the caster board of FIG. 1, taken along the line A-A of FIG. 4. FIG. 10 is a detail cross-sectional view of a rear of the caster board of FIG. 1.

As can be seen in FIG. 1, the caster board 100 includes a front region 102, a rear region 104, and a neck region 106 extending between the front region 102 and the rear region 104. The front and rear regions 102, 104 can form a deck or platform 110, which can support and/or receive the feet of a user. In the illustrated embodiment, the front region 102 includes a front platform section 112 of the deck or platform 110, and an underlying front caster assembly 130*a*. The rear region 104 includes a rear platform section 114 of the platform 110, and an underlying rear caster assembly 130*b*. The neck region 106 includes a first neck section 116*a* and a second neck section 116*b* extending between the front platform section 112 and the rear platform section 114 of the platform 110. As illustrated, in some embodiments, the first and second neck sections 116*a*, 116*b* (also called first and second neck portions) can be positioned on either side of an aperture 160 extending into and/or through the platform 110. The aperture 160 can comprise a through-hole, blind hole, groove, recess, notch, or otherwise. In some implementations, one or more of the neck sections 116*a*, 116*b* provides a handle for carrying the board 100.

In the illustrated embodiment, the platform 110 is a single piece, such as a piece which may be molded or otherwise integrally formed into a desired shape. In some embodiments, the platform 110 may comprise a plastic material, or any other suitable material which may be resiliently twisted during operation of the caster board, as discussed in greater detail herein. In some implementations, the platform 110 is not comprised of and/or assembled from discrete front and rear sections that are connected by a discrete neck and/or torsion bar.

A lateral width of the front platform section 112 and a lateral width of the rear platform section 114 may be greater than a lateral width between the outer edge 126*a* of first neck section 116*a* and outer edge 126*b* of second neck section 116*b* in the neck section 106 of the caster board 100. The width of the front platform section 112 and the rear platform section 114 allow these sections to support a respective foot of a rider during operation of the caster board 100. In some variants, the increased width of the front platform section 112 and the rear platform section 114 allows these sections to resist twisting and/or to concentrate the twisting of the platform 110 within the neck region 106 of the caster board 100, as discussed in greater detail herein.

In the illustrated embodiment, such as can be seen in FIG. 3, the front platform section 112 includes a front edge 120*a*, which in the illustrated embodiment is somewhat convex. There can be a distinct rounded transition between the front edge 120*a* and side edges 122*a* and 122*b* of the front platform section 112, which are generally linear with a slight convex curvature, and taper slightly outward with increased distance from the front edge 120*a*. Rearward of the side edges 122*a* and 122*b*, there is another distinct rounded transition between the side edges 122*a* and 122*b* to the inwardly tapering inboard sides 124*a* and 124*b* of the inboard portion of the front platform section 112. The inboard sides 124*a* and 124*b* are separated from the outer edge 126*a* of first neck section 116*a* and outer edge 126*b* of second neck section 116*b* by additional distinct rounded transitions.

In some embodiments, the rear platform section 114 is similar to the front platform section 112. As shown, in some variants, the rear edge 120*b* of the platform 110 has a slightly concave shape. The side edges 122*c* and 122*d* of the rear platform section 114 can be generally linear, have a slight convex curvature, and/or taper slightly outward with increased distance from the rear edge 120*b*. Forward of the side edges, the inwardly tapering inboard sides 124*c* and 124*d* of the rear platform section 114 taper respectively to the outer edge 126*a* of first neck section 116*a* and the outer edge 126*b* of second neck section 116*b*

In some embodiments, the front and rear platform sections 112 and 114 may have shapes which are more or less angular than the illustrated embodiment. In some embodiments, one or both of the front and rear platform sections 112 and 114 may include one or more curvilinear edges in place of two or more of the adjacent edges depicted herein. In addition, the transition between the front and rear platform sections 112 and 114 and the first and second neck sections 116*a* and 116*b* may not include a discrete rounded transition. Instead, a single curvilinear edge may extend along at least a portion of one of the first and second neck sections 116*a* and 116*b* and at least one of the front and rear platform sections 112 and 114.

The upper surface 118 of the platform 110 is not planar in the illustrated embodiment but includes a central recessed portion 170 that extends from the front platform section 112 to the rear platform section 114, with a raised lip 172 surrounding it. The peak of the raised lip 172 is recessed from some or all of the edges of the platform 110, with an outer portion 174 extending downward to a sidewall of adjacent edge of the platform 110. The outer portion 174 may include a bevel, chamfer, or fillet. At least a portion of the sidewalls at the edges of the board may be substantially vertical. The height of the sidewall may vary across the length of the board. For example, in the illustrated embodiment, the height of the sidewall within the neck region 106 may be comparatively greater than the height of the sidewall in the front and rear regions 102 and 104 of the board 106.

In the illustrated embodiment, the first and second neck portions 116*a* and 116*b* have a substantially constant thickness across some or most of their lengths. The first and second neck portions 116*a*, 116*b* can be oriented at a slight acute angle to the longitudinal axis 108 of the caster board 100. In particular, the first and second neck portions 116*a* and 116*b* are oriented along respective longitudinal axes which converge at a point rearward of the neck portion 106. In some implementations, the acute angle is less than or equal to about: 25°, 20°, 15°, 10°, 5°, 4°, 3°, 2°, 1° or otherwise. In the particular embodiment illustrates in FIGS. 1 to 10, the convergence point of these axes may be rearward of the back edge 120*b* of the board 100. Certain embodiments may include different orientations of the first and second neck portions 116*a* and 116*b* relative to one another. In some embodiments, the first and second neck portions 116*a* and 116*b* may be oriented generally parallel to one another, and parallel to the longitudinal axis 108 of the caster board 100.

As mentioned above, the caster board 100 can comprise an aperture 160 (e.g., a through-hole), which can be located between the first and second neck portions 116*a* and 116*b*. In some embodiments, the aperture 160 can is centrally located, such as at about the midpoint of: the longitudinal length of the caster board 100, the lateral width of the caster board 100, and/or the longitudinal length of the neck portions 116*a* and 116*b*. The generally longitudinally extending sidewalls 162*a* and 162*b* of the aperture 160 are bounded by the interior sides of the first and second neck portions 116*a* and 116*b*. The orientation of the first and second neck portions 116*a* and 116*b* can be at a non-zero angle to one another, as shown in FIGS. 3 and 4. In some implementations, because of this non-zero angle and the generally constant thickness of the first and second neck portions 116*a* and 116*b*, the aperture 160 has a generally trapezoidal shape, having a thicker width closer to the front sidewall 164*a* of the aperture 160, and having a thinner width closer to the rear sidewall 164*b* of the aperture 160. In some embodiments, the aperture 160 tapers vertically, such as being wider at a top (e.g., flush with the top of the platform 110) and narrower at the bottom of the aperture 160. This longitudinally and/or vertically asymmetrical shape can compel a particular orientation of an object or objects dimensioned to be inserted into the aperture 160, as discussed in greater detail elsewhere herein. In some embodiments, the tapered shape of the aperture 160 aids in receiving and/or securing an insert in the aperture 160, as is discussed in more detail below.

The aperture 160 can include a chamfered upper portion 168 extending around the upper perimeter of the aperture 160. In the illustrated embodiment, the chamfered upper portion 168 is oriented at larger angles to the surrounding upper surface 118 of the platform 110 than the angles at which the chamfered upper portion 168 is oriented to the sidewalls 162*a*, 162*b*, 164*a*, and 164*b* of the aperture 160. The sections of the chamfered upper portion 168 located forward and rearward of the aperture 160 may be oriented at a shallower slope than the sections of the chamfered upper portion 168 located to the sides of the aperture 160. As discussed in greater detail elsewhere herein, the chamfered upper portion 168 can facilitate retention of an object or objects dimensioned to be inserted into the aperture 160.

The platform 110 of the caster board 100 is supported by a pair of longitudinally aligned caster assemblies 130*a* and 130*b*. Each of the caster assemblies 130*a* and 130*b* includes a king bolt 142 used to mount the caster assemblies 130*a* and 130*b* to the underside of the platform 110. In particular, the king bolts 142 are inserted through an aperture in angled mounting surfaces 178*a* and 178*b* oriented at an oblique angle to the platform 110. In the illustrated embodiment, the angled mounting surfaces 178*a* and 178*b* are part of wedge-shaped depressions 176*a* and 176*b* in the platform 110. In some embodiments, the angled mounting surfaces 178*a* and 178*b* may be defined by an intermediate structure which is secured to the platform 110. The depressions 176*a* and 176*b* may be hidden and/or covered with cover plates (not shown). The cover plates can be received in and/or connected to the depressions 176*a* and 176*b*. The cover plates can be generally flush with a top of the platform 110 and/or can obscure from sight the presence of the depressions 176*a* and 176*b*.

In the illustrated embodiment, angled mounting surfaces 178*a* and 178*b* are parallel to one another, such that the king bolts 142 of the caster assemblies 130*a* and 130*b* are installed along parallel axes which intersect the longitudinal axis 108 of the caster board 100. The axes of the king bolts 142 intersect the longitudinal axis at an oblique angle. In some embodiments, this oblique angle is less than 45 degrees, and in some particular embodiments, this oblique angle is roughly 30 degrees. The angle at which the king bolts 142 is installed is a function of the angle of the angled mounting surfaces 178*a* and 178*b*, which in turn is a function of the geometry of the wedge-shaped depressions 176*a* and 176*b* in the platform 110.

The king bolts 142 of the caster assemblies 130*a* and 130*b* support caster yokes or forks 140, the arms of which extend on either side of the wheels 132 to support the wheel pin or axle 134 extending therebetween. The caster assemblies 130*a* and 130*b* may be rotatable 360 degrees about the king bolts 142. In some embodiments, the range of rotation of the caster assemblies may be constrained to inhibit rotation beyond a certain range.

This rotation may be facilitated through the use of one or more bearings. In the illustrated embodiment, each of the caster assemblies 130*a* and 130*b* include a thrust bearing 144 disposed between the crossbar of the fork 140 and the angled mounting surface 178*a* or 178, and a radial bearing 146 disposed between the crossbar of the fork 140 and the head of the king bolt 142, between the arms of the fork 140. The use of one or more suitable bearings allows rotation of the caster assemblies 130*a* and 130*b* even when the caster assembles 130*a* and 130*b* are under the load of a rider operating the caster board 100.

In the illustrated embodiment, the head of the king bolt 142 is located adjacent the wheel 132, and a nut 148 on the opposite side of the angled mounting surface 178*a* or 178*b* is used to retain the king bolt 142 in place. In some embodiments the orientation of the king bolt 142 and nut 148 may be reversed. In some embodiments, other suitable king pin structures other than a threaded nut and bolt may be used to retain the caster assemblies 130*a* and 130*b* in place.

The forks 140 of the caster assemblies 130*a* and 130*b* support the wheel 132 in an offset position, in which the axis of the king bolt 142 does not intersect the wheel axle 134. Instead, the wheel axle 132 is radially offset from the axis of the king bolt 142. Rotation of the caster assemblies 130*a* and 130*b* sweeps the wheel 132, and particular the contact point of the wheel 132 with an underlying surface, out of a plane defined by the axis of the king bolt 142 and the longitudinal axis of the caster board. The offset of the fork 140 will affect the swivel radius of the caster assembly, with an increase in the offset corresponding to an increase in the swivel radius. In the illustrated embodiment, the offset of the fork 140 is greater than the radius of the wheel 132, such that the axis of the king bolt 142 will not intersect the wheel 132.

In some embodiments, the caster assemblies 130*a* and 130*b* may be self-centering and may be biased to return to a position in which the wheel 132 is aligned with the longitudinal axis of the caster board 100. In some embodiments, the caster assemblies 130*a* and 130*b* may include a self-centering mechanism such as a coil spring torsion spring (not shown), configured to exert a restoring force on the caster assembly 130*a* or caster assembly 130*b* when the caster assembly rotates such that the wheel 132 is oriented at an oblique angle to the longitudinal axis 108 of the caster board 100. In some embodiments, the self-centering mechanism may be external to the caster assembly, connected between a portion of the platform 100 and a portion of the caster assembly 130*a* or 130*b*. In some embodiments, the self-centering mechanism may be at least partially internal to the caster assembly, such as through the use of an internal torsion spring.

The underside of the platform 110 includes a plurality of ribs which provide support for the upper surface of the platform 110, allowing the platform to bear the weight of a rider. The plurality of ribs, in conjunction with the overall shape and dimensions of the board and the material or materials comprising the board, also affect the resistance of the board to twisting, as discussed in greater detail herein.

In the illustrated embodiment, a plurality of generally laterally extending ribs 154 extending from the sidewalls on one side of the platform 110 to the sidewalls on the other side of the platform 110, except where they intersect the aperture 160 or the wedge-shaped depressions 176*a* and 176*b* in the platform 110. As can be seen in FIGS. 6 and 7, the height of these sidewalls may increase near the longitudinal axis 108 but be thinner near the outer sidewalls of the platform 110. Such an arrangement may provide clearance for the platform 110 when it is a canted position with one side closer to the ground. The laterally extending ribs 154 are not linear in the illustrate embodiment, but instead have a curved shape, with the center of curvature of each laterally extending ribs 154 located rearward of that rib. The curvatures of the laterally extending ribs 154 may be similar to each other and may in some embodiments be similar to the curvature of the front edge 120*a* and/or the rear edge 120*b*. The longitudinal spacing between the laterally extending ribs 154 may vary over the length of the platform 110, with the spacing between the laterally extending ribs 154 being greater within the first and second neck sections 116*a* and 116*b*.

In addition, the platform 110 may include a plurality of generally longitudinally extending ribs. A central longitudinally extending rib 150 extends along a longitudinal axis of the board from the frontmost laterally extending rib 154 to the rearmost laterally extending rib 154, except where it intersects the aperture 160 and the wedge-shaped depressions 176*a* and 176*b* in the platform 110. In addition, outer generally longitudinally extending ribs 152 extend between the front end 120*a* of the platform 110 and the back end 120*b*. The outer ribs 152 generally follow the outside edge of the platform 110, tapering inward near the first and second neck sections 116*a* and 116*b* to extend along a central region of the first and second neck sections 116*a* and 116*b*.

The front platform section 112 and the rear platform section 114 provide comparatively stiff sections of the platform 110, on which a rider can place their feet during operation of the caster board 100. The neck region 106 of the caster board 100 is less resistant to twisting than the front platform section 112 and the rear platform section 114, due to the comparatively narrow cross-sectional shape of the neck region 106 and the inclusion of the aperture 160 extending therethrough. However, the neck region 106 of the board may still be provided with sufficient vertical support to resist significant downward bowing when a rider places their foot on the neck region. In some embodiments, the taller vertical sidewall along the outer edge 126*a* of first neck section 116*a* and outer edge 126*b* of second neck section 116*b* in the neck section 106 may provide resistance to flexure away from the longitudinal axis 108 of the caster board 100.

Because the front platform section 112 and the rear platform section 114 are more resistant to twisting than the neck section 106, the shape of the front platform section 112 and the rear platform section 114 will remain generally constant during operation, even during twist-induced locomotion, providing a more stable riding experience for the rider. The neck section 106 can be configured to resiliently twist during operation of the board 100, as discussed in more detail below. In some embodiments, the neck section 106 twists about a longitudinal axis of the board 100. The neck section 106 can be configured to provide sufficient twisting resistance and resiliency to enable normal riding operation of the board 100. Several embodiments do not require and/or include a separate torsion strut located outside of the neck section 106. For example, various embodiments do not have a torsion bar that is positioned under the neck section 106 and/or not in the same plane as the neck section 106, which would limit the ground clearance, increase complexity, add weight, and/or reduce the size of insert that could received in the aperture 160. In several embodiments, from a top view (see FIG. 3), no portions of the board 100 are visible through the aperture 160 and/or a user on the board 100 has an unimpeded view to the ground through the aperture 160.

In operation, because the caster assemblies 130*a* and 130*b* are located beneath the front platform section 112 and the rear platform section 114, respectively, the caster assemblies 130*a* and 130*b* will be reoriented in response to tilting of the overlying platform section. In particular, this tilting may be due to the application of a force which is laterally offset from the longitudinal axis 108 of the caster board 100.

During operation of the caster board 100, or of any skateboard, a rider may align their weight with the longitudinal axis 108 of the caster board 100 in order to inhibit or prevent tilting of the deck of the skateboard and continue moving in the current direction without changing course. If a rider wishes to steer the skateboard, a rider may shift their weight such that one or both of their feet are applying force in an offset manner, such as by rotating their body, rocking on their feet, and/or shifting their weight and/or foot positions, in order to control the movement of the skateboard. A caster board such as caster board 100 may be operated in a similar fashion.

Figure 11A:
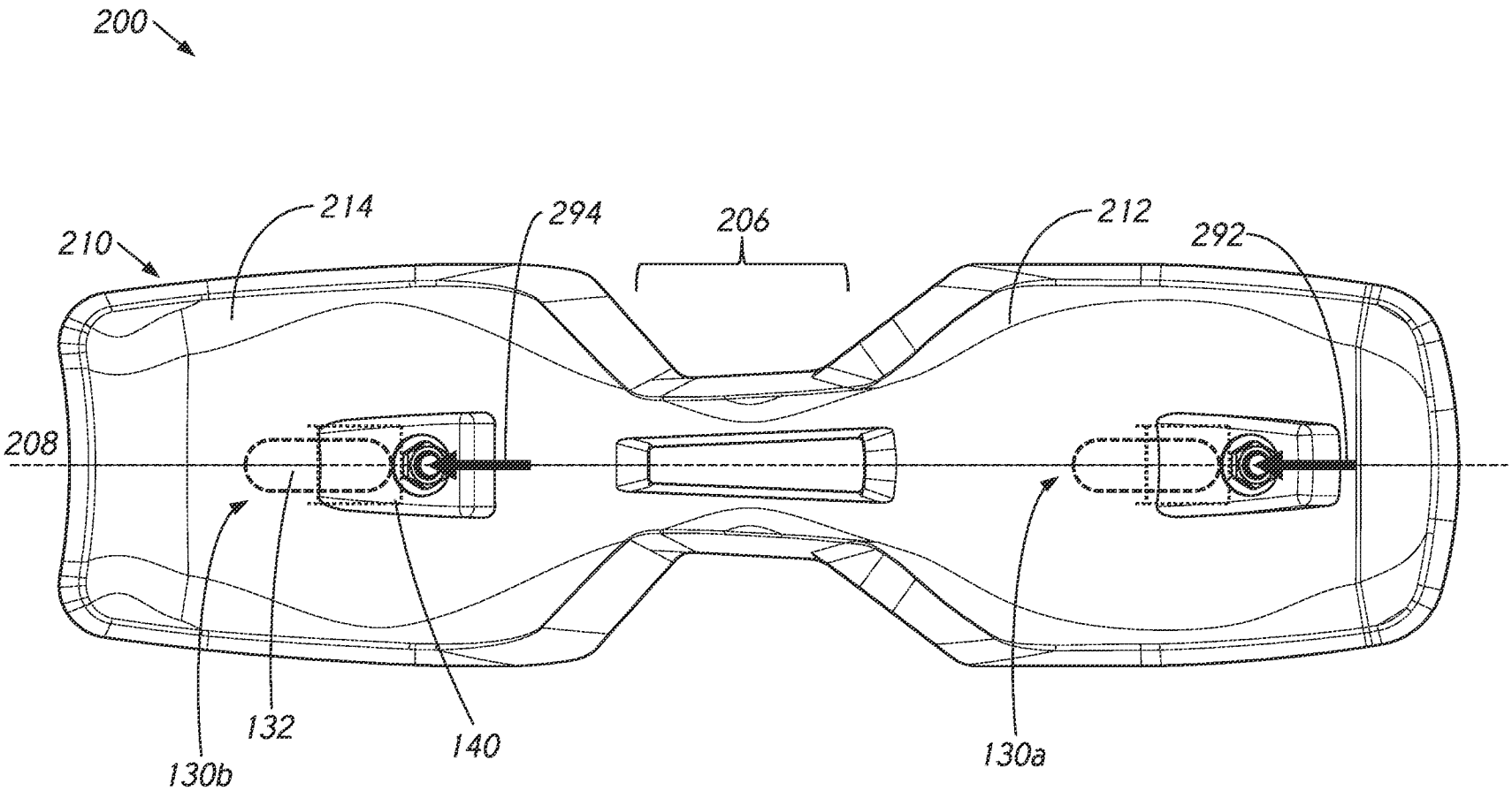
FIGS. 11A to 11E schematically illustrate an embodiment of a caster board under various loading conditions and the resulting positions of the caster assemblies.

FIG. 11A illustrates an embodiment of a caster board 200 with caster assemblies 230*a* and 230*b* shown in outline to illustrate the positions of the front and rear wheels 232 and the forks 240. In FIG. 11A, the rider is positioned on the board such that their weight is substantially aligned at both the front platform section 212 and the rear platform section 214 with the longitudinal axis 208 of the board. The net force 292 acting on the front platform section 212 is aligned with the longitudinal axis 208, as is the net force 294 acting on the rear platform section 214. The deck 210 does not tilt under this loading, and the wheels 230 of the caster assemblies 230*a* and 230*b* remain aligned with the longitudinal axis 208 of the board 200, and the board 208 continues moving forward in the same direction.

Figure 11B:
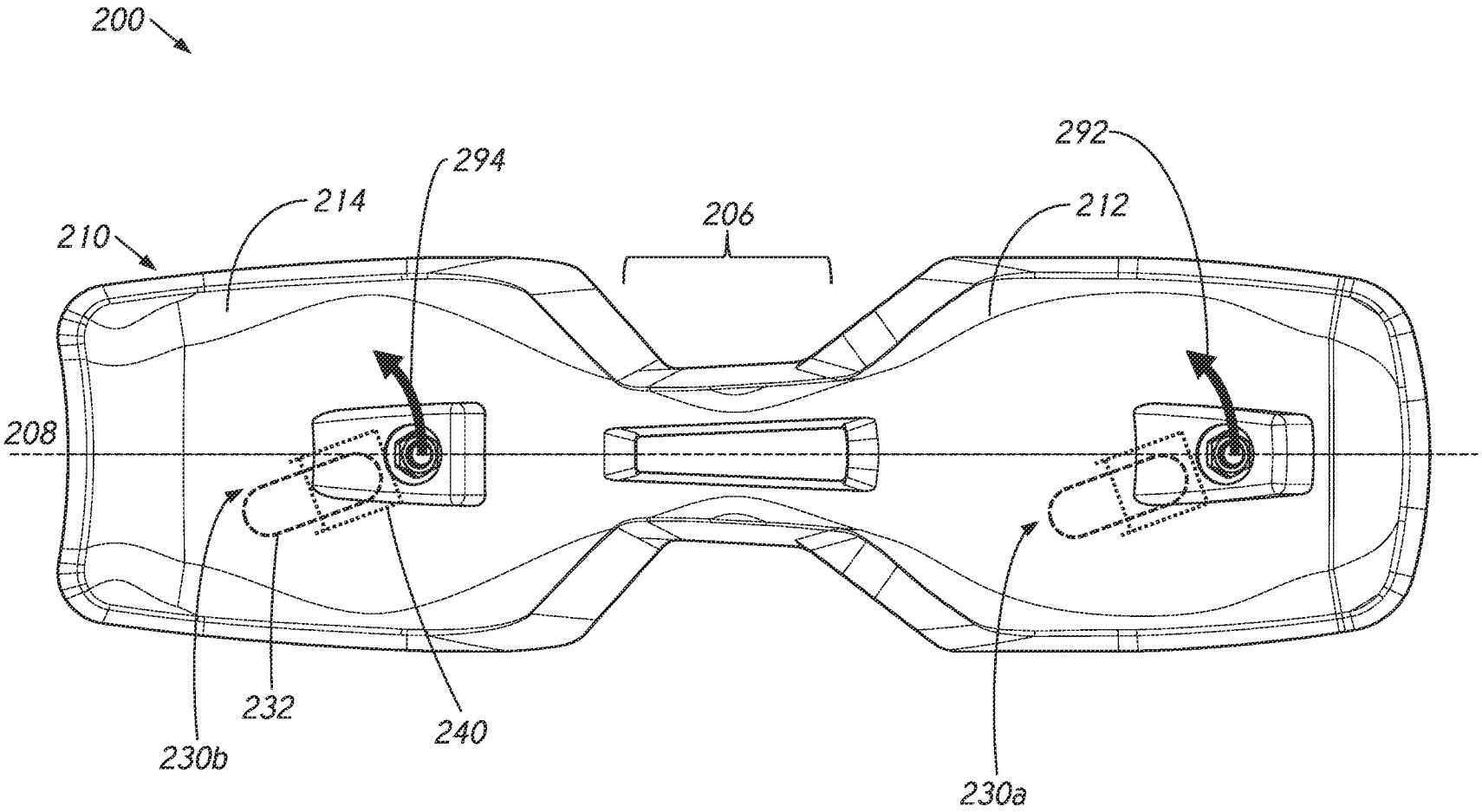

In FIG. 11B, the caster board 200 is steered in a similar manner as a traditional skateboard. The rider has shifted their weight to the left side of the skateboard at both the front platform section 212 and the rear platform section 214. The net forces 292 and 294 acting on the front and rear platform sections 212 and 214, respectively, are laterally offset in the same direction from the longitudinal axis 208, and the board 208 will tilt to the left without twisting. Because the caster assemblies 230*a* and 230*b* trail their respective mounting points, the caster assemblies 230*a* and 230*b* swing in a counterclockwise direction, reorienting the wheels 232 as shown. The board 200 will then turn to the left in response to the rider's shift in position.

Figure 11C:
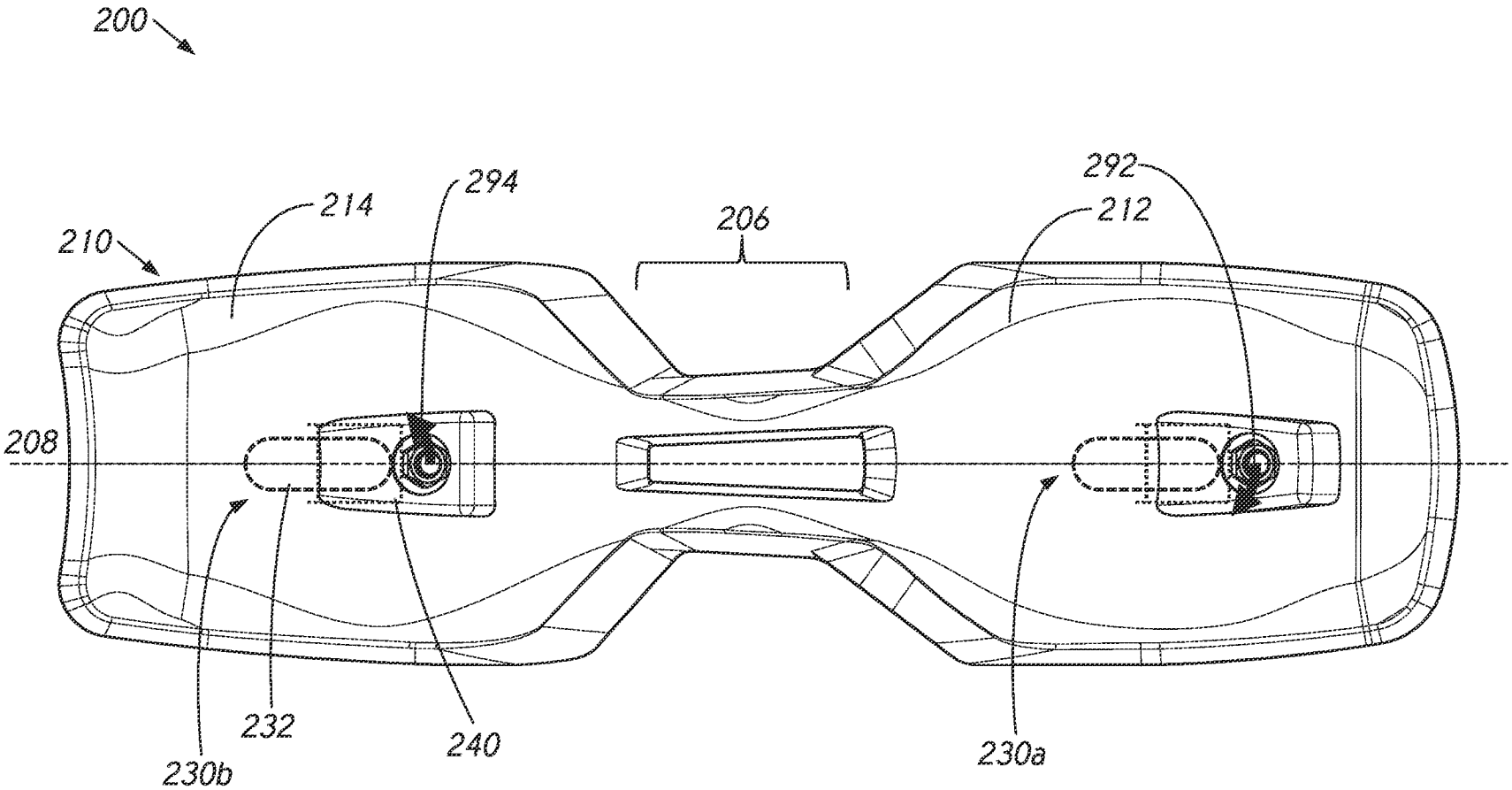

In some embodiments, the caster board 200 may be configured such that a small force differential will not result in significant twisting of the board. FIG. 11C illustrates a state in which there is a small force differential between the front and rear portions of the caster board, insufficient to result in significant twisting of the board. It can be seen that the net force 292 acting on the front platform section 212 is laterally offset slightly to the right of the longitudinal axis 208, although the net torque applied by this offset is small, due to the small offset. Similarly, the net force 294 acting on the rear platform section 214 is laterally offset slightly to the left of the longitudinal axis 208, applying a small net torque in the opposite direction. The opposing forces of similar magnitude do not result in tilting of the board either to the left or the right, just as a traditional skateboard would not be tilted under the same loading.

Because the platform 210 of the caster board 200 has some resistance to twisting, the front platform section 212 does not twist substantially with respect to the rear platform section 214, so that neither the front platform section 212 nor the rear platform section 214 assume a tilted position with respect to the neutral position of the platform 210. Within a certain range of applied force, the caster board 200 operates in a manner similar to a traditional skateboard, allowing a rider to use the caster board 200 in a fashion similar to a traditional skateboard.

Figure 11D:
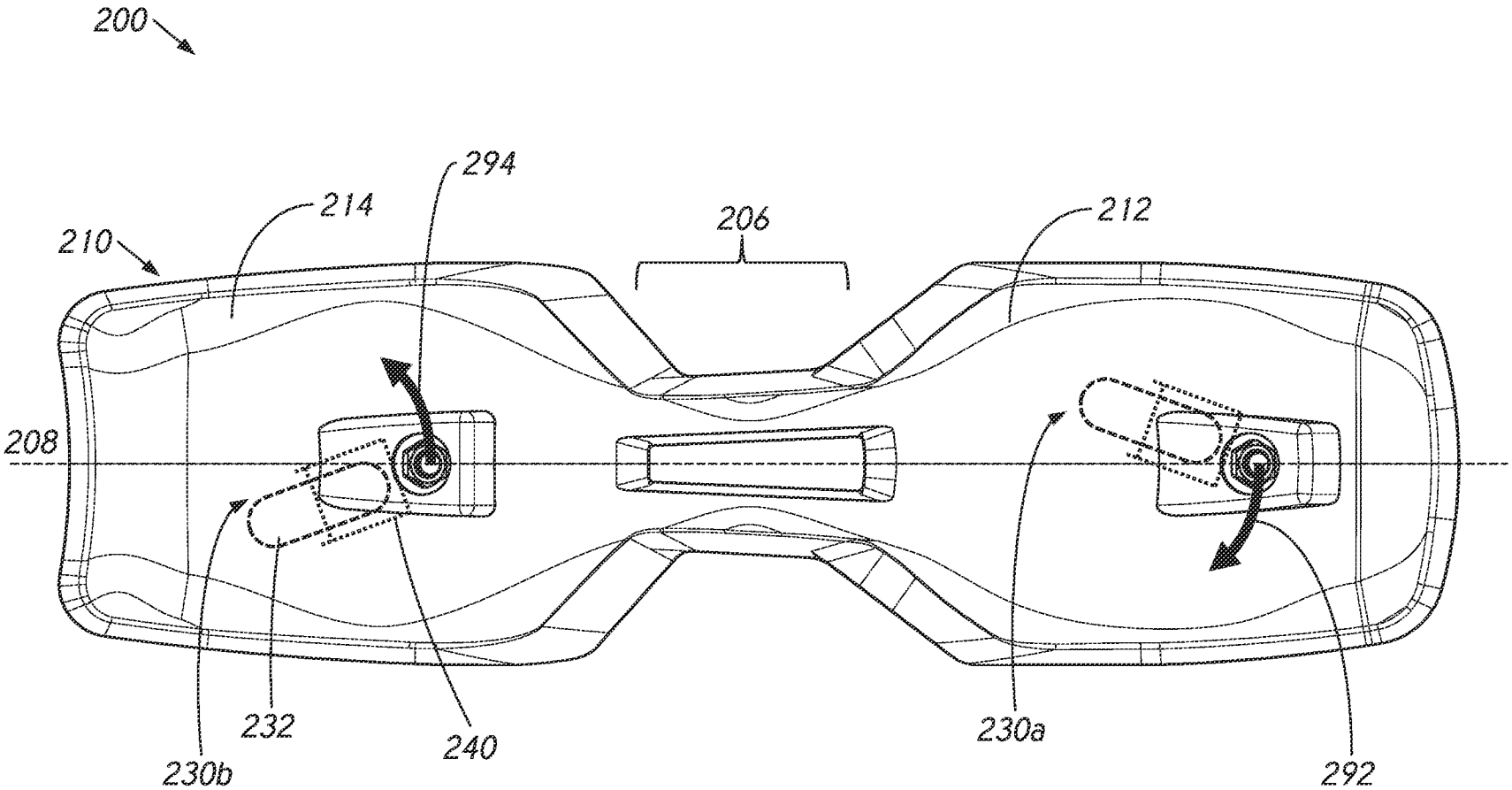

At higher applied force differentials, however, the operation of the caster board diverges from that of a traditional skateboard. FIG. 11D illustrates a state in which there is a large force differential between the front and rear portions of the caster board, sufficient to result in significant twisting of the board. It can be seen that the net force 292 acting on the front platform section 212 is laterally offset significantly to the right of the longitudinal axis 208. This significant offset results in substantial net torque being applied at the front platform section 212. Similarly, the net force 294 in acting on the rear platform section 214 is laterally offset significantly to the right of the longitudinal axis 208, resulting in a substantial net torque in the opposite direction being applied at the rear platform section 214.

For a stiff traditional skateboard with significant resistance to twisting, the large force differential will not result in tilting of the deck of the skateboard so long as the net torques are similar in magnitude and opposite in direction. Such a traditional skateboard will, under this loading, continue moving in the same direction.

In contrast, the caster board 200 will behave differently than a traditional skateboard under this loading. In the caster board 200, the front platform section 212 is connected to the rear platform section 216 by a narrower divided neck portion 206 with substantially less torsional stiffness than a traditional skateboard or the front and rear platform sections 212 and 214. The force differential will result in twisting of the platform 210, where the twisting is primarily localized in the narrower divided neck portion 206, so that the front platform portion 212 tilts to the right, and the rear platform portion 214 tilts to the left. The rightward tilt of the front platform portion 212 will result in the caster assembly 230*a* rotating in a clockwise direction, and the leftward tilt of the rear platform portion 214 will result in the caster assembly 230*b* rotating in a counterclockwise direction.

If the rider then shifts their weight in the opposite direction, the board will twist back through a neutral shape and twist in the opposite direction. FIG. 11D illustrates a loading condition of a caster board which is the opposite of the loading condition depicted in FIG. 11E. The force differential will again result in twisting of the platform 210, but under this loading, the front platform portion 212 tilts to the left, and the rear platform portion 214 tilts to the right. The leftward tilt of the front platform portion 212 will result in the caster assembly 230*a* rotating in a counterclockwise direction, and the rightward tilt of the rear platform portion 214 will result in the caster assembly 230*b* rotating in a clockwise direction.

Figure 11E:
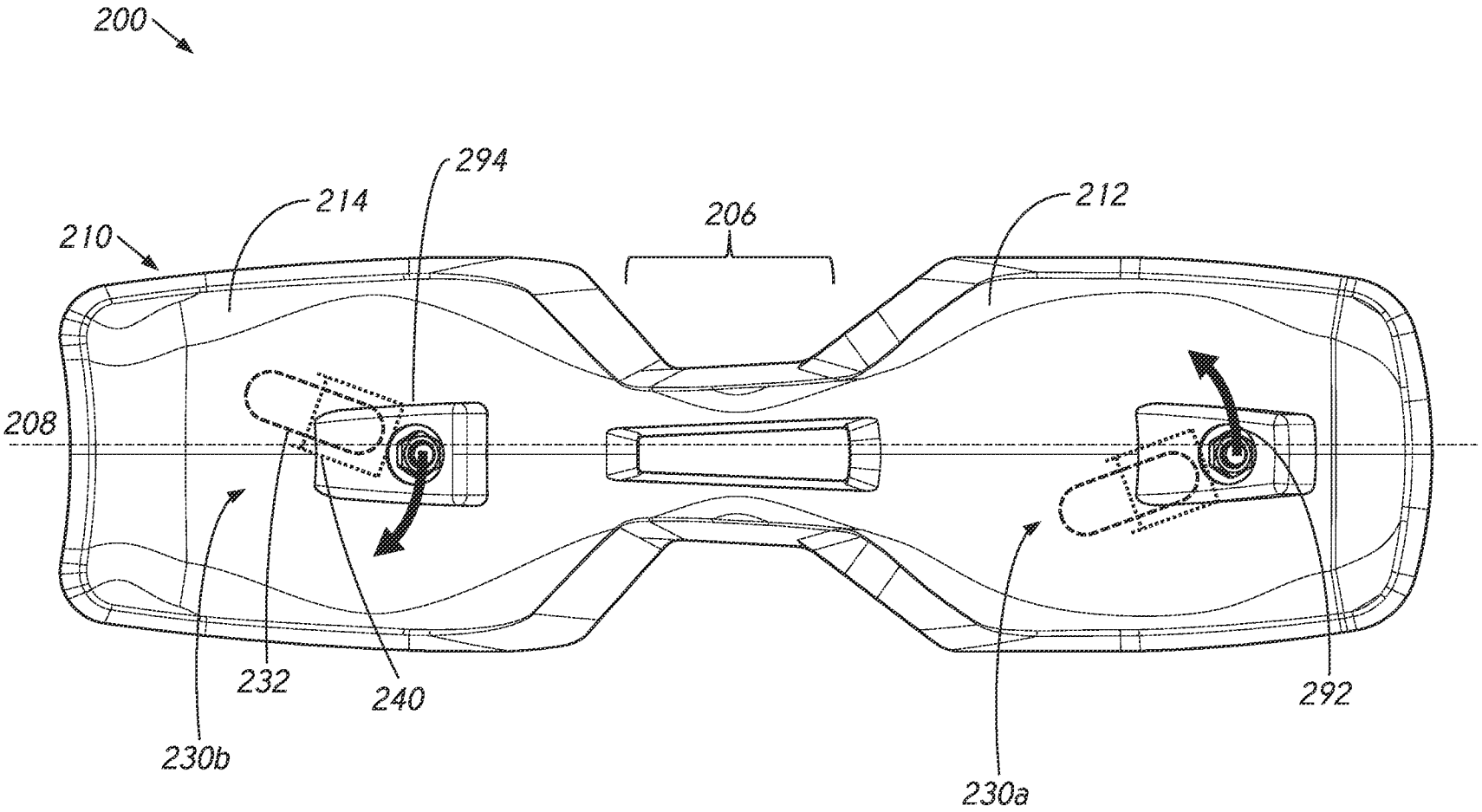

In addition to swinging outward from the longitudinal axis 208 as shown in FIGS. 11D and 11E, the wheels 232 of the caster assemblies 230*a* and 230*b* will not remain vertical but will instead be canted inward towards the longitudinal axis 208 of the caster board 200. As a rider repeatedly shifts their weight to vary the loading between the loading illustrated in FIG. 11D and the loading illustrated in FIG. 11E, the twisting motion of the caster board 200 will generate or maintain forward movement of the caster board 200, allowing a rider to propel themselves without the need to push their foot against the ground to propel the caster board 200 forward. The relative rotation of different sections of the platform 210 about the longitudinal twist axis 208 of the caster board 200 changes the angle at which the weight of the rider is applied to each of the caster assemblies 230*a* and 230*b*, causing them to rotate about their pivot axes. This rotational movement of the caster assemblies 230*a* and 230*b* can be used to add energy to the rolling motion of each wheel 232 of the caster assemblies 230*a* and 230*b* about its rolling axis and can be used to steer the caster board 200.

For example, a rider may maintain the position of their right foot on rear platform section 214 generally perpendicular to the longitudinal axis 208 of the caster board 200 and parallel to the ground, and maintain the position of their left foot on front platform section 212 generally perpendicular to the longitudinal axis 208 of the caster board 200 and parallel to the ground. If the rider, while in this position, lowers the ball of their front foot and/or lifts the heal of their front foot, the front platform section 212 will twist clockwise relative to the rear platform section 214 when viewed from the rear of the caster board 200. This twist of the front platform section 212 causes the weight of the rider to be applied to the wheel 232 of the front caster assembly 230*a* at an angle to the ground, rather than orthogonal to the ground, causing the wheel 232 to begin to roll, to maintain a previous rolling motion, and/or to increase the speed of motion of the caster board 200 by adding energy to the rolling motion of the wheels.

The rider can cause such a twist of platform 210 of board 200 in several ways, which may be used either alone or in combination. For example, the rider can cause such a twisting motion of the platform 210 by twisting or rotating their body, applying pressure with the toe of one foot while applying pressure with the heel of the other foot, by changing foot positions and/or by otherwise shifting their weight. To provide substantial locomotion, the rider can first cause a twist along longitudinal axis 208 in a first direction and then reverse their operation and cause the platform to rotate back through a neutral position and then into a twist position in the opposite direction. While moving forward, the rider can use the same types to motion, but at differing degrees, to control the twisting to steer the motion of board 200.

In the illustrated embodiments, the neck region 206 of the caster board has an asymmetrical shape, due to the angle of the neck portions relative to the longitudinal axis 208 of the caster board. This asymmetrical shape causes a corresponding asymmetrical variation in torsional stiffness along the length of the neck portion 206, with the narrower portion of the neck portion 206 adjacent the rear platform 214 having the lowest torsional stiffness.

Figure 12:
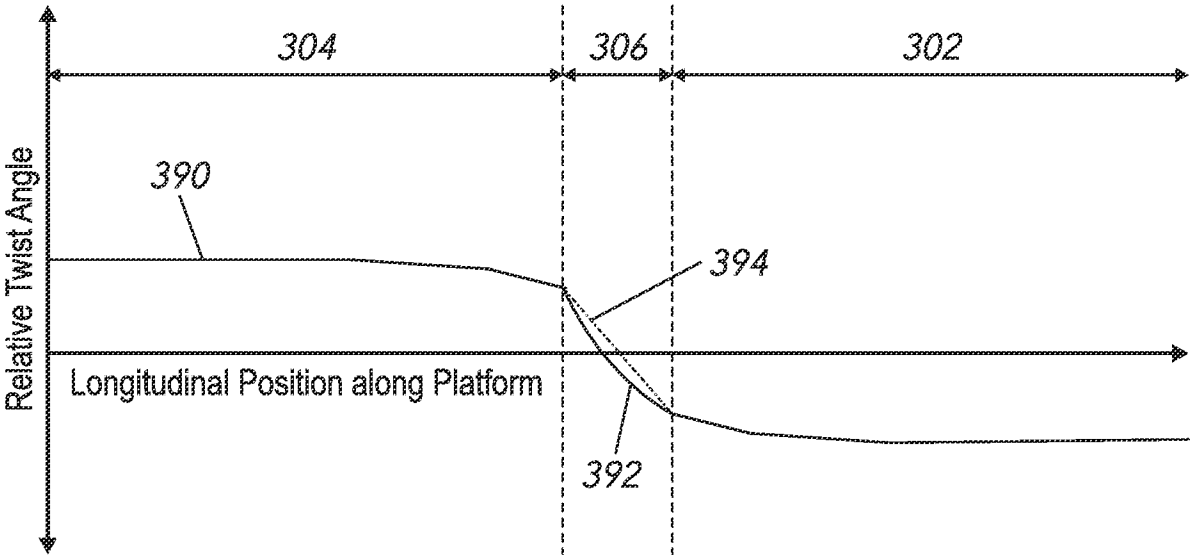
FIG. 12 illustrates a plot of relative twist angle along the length of a platform in response to an applied torque.

FIG. 12 illustrates a plot of relative twist angle along the length of a platform in response to an applied torque. It can be seen in the plot 390 of relative twist angle as a function of longitudinal position along the platform, that the bulk of the twist is localized within the neck region 306, with little change in twist angle over the front region 302 containing a wider front platform section or over the rear region 304 containing a wider rear platform section.

For a platform with a longitudinally symmetric neck design along the length of the neck, the relationship between twist angle and position may be linear within the neck portion, or may be at least partially non-linear with an inflection point at the center of the neck region, depending on the specific design of the neck. An example of such a relationship is shown as line 394. However, it can be seen that the change in twist angle as a function of position in section 392 of plot 390 is more concentrated within a narrower portion of the asymmetric neck region 306, where the torsional stiffness of the neck region 306 is at a minimum.

The asymmetrical design of certain embodiments described herein, in which the thinnest portion of the neck region is located near the rear platform section, may provide certain advantages for a rider. A rider may be more likely to utilize their dominant foot as their rear foot. As such, the locomotion of the caster board may be primarily driven by the motion of the rear, dominant foot. By reducing the torsional stiffness of the neck region near the rear platform, it may be easier for a rider to propel themselves forward using the repetitive twisting motion described above.

In some embodiments, the caster board may be configured to receive one or more inserts into an aperture extending into or through the neck region of the caster board. The caster board can include one or more securing features to hold an insert in place within the aperture, such as stops, clasps, clamps, detents, levers, friction fits, magnets, or otherwise. The caster board can be configured such that the insert can be readily removable from the aperture, such as by deactivating (e.g., loosening) a securing feature and/or by pulling the insert out of the board in a direction generally perpendicular to the deck (e.g., upward). The insert can have a peripheral shape that corresponds to the peripheral shape of the aperture.

Figure 13:
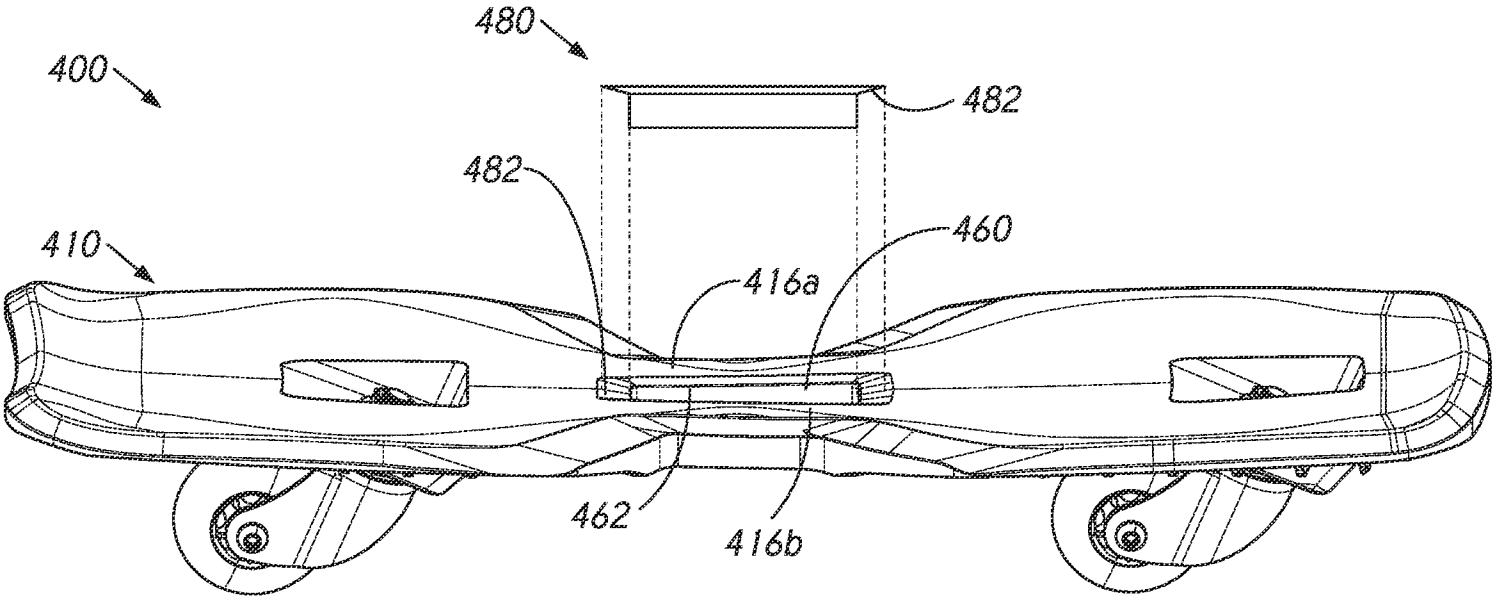
FIG. 13 is an exploded view of a caster board and an insert dimensioned to fit within the aperture in the caster board.

FIG. 13 is an exploded view of a caster board and an insert dimensioned to fit within the aperture in the caster board. The caster board 400 includes an aperture 460 located between first and second neck sections 416*a* and 416*b*. The aperture includes a chamfered upper portion 468 adjacent the upper surface of the platform 410 and/or substantially vertical sidewalls 462. Certain embodiments may include apertures having other designs, as discussed herein.

In the illustrated embodiment, an insert 480 is dimensioned to fit within the aperture 460, with an outwardly extending portion 482 near the upper surface of the insert 480. The outwardly extending portion 482 may cooperate with the chamfered upper portion 468 of the aperture 460 to inhibit or prevent the insert 480 from falling through the aperture 460, and/or to define an upper surface which is at least somewhat coplanar or otherwise contiguous with the surrounding upper surface of the platform 410. In some embodiments, when installed in the aperture, an upper surface of the insert is generally flush with the upper surface of the platform. In some variants, the upper surface of the insert is recessed below the upper surface of the platform or projects above the upper surface of the platform. In some embodiments, the upper surface of the insert is generally flat and/or is contoured to match and/or to be an extension of the contours of the platform adjacent the aperture. This can make it appear that the insert is part of the platform and/or can provide additional space for the user to position a body part (e.g., can put some or all of a foot on the upper surface of the insert).

A wide variety of other insert shapes may also be used. In some embodiments, the aperture may include one or more rails, notches, grooves or other retention structure, which may cooperate with a corresponding structure on an insert to provide a more secure fit between the insert and the caster board. In some embodiments, an insert may occupy only a portion of the aperture, leaving another portion of the aperture free from an insert. Because the aperture may have a longitudinally and/or vertically asymmetrical shape, such as is shown, the shape of the insert may compel a particular orientation of the insert relative to the aperture. For example, the insert may be insertable into the aperture in only a single orientation. In some embodiments, for example, an insert may have a length less than that of the aperture, but a width and shape that requires that the insert be inserted at the widest point of the aperture, adjacent the front platform section.

In various embodiments, the inserts may include a wide variety of mechanisms or components and may be used for a wide variety of purposes. For example, in some embodiments, the insert is configured to alter a mechanical or structural property of the caster board when inserted into the aperture in in the caster board. This can beneficially allow riders to customize the properties of the caster board based on a variety of factors, including their body size, skill level, riding environment, current activity, or any other suitable factor.

In some embodiments, the insert can comprise an elastomer or other material that can be added to the gap, and which can adjust the effective spring rate of the neck to alter the torsional stiffness of the neck region. Adjusting the effective spring rate of the neck and/or the torsional stiffness of the neck can change the magnitude of torque required to twist the neck and pivot the front platform section of the caster board relative to the rear platform section of the caster board. The change in torsional stiffness can alter the mechanical properties of the caster board, such as steering or stability.

In some embodiments, a weight or series of weights can be affixed to the neck or added to the gap using some attachment mechanism. The weight or weights can be fixed to a specific location or movable to different locations on the neck. The weight or weights can be of different masses. Adding mass to the neck or shifting the location of mass supported by the neck, can alter the mechanical properties of the caster board, such as steering or stability.

In some embodiments, the caster board may not undergo significant twisting under a certain torque threshold, so that the caster board can be operated in a manner similar to that of a traditional skateboard. Increasing the stiffness of the neck portion can increase the torque threshold required to twist the front platform section relative to the rear platform section, which may alter the riding experience while using such a caster board. For example, a rigid or semi-rigid insert may increase the torque threshold required to cause significant twisting of the front platform section relative to the rear platform section, making it easier for a rider to operate the caster board as a traditional skateboard, without inducing undesired twisting. This may provide a rider with the flexibility to operate the caster board as a traditional skateboard when desired, and remove the insert to facilitate operation as a caster board and induce locomotion of the board across a riding surface via repetitive twisting of the front and rear platforms relative to one another.

In some embodiments, the insert may perform a function other than structural modification of the caster board. For example, in some embodiments, the insert can comprise an electronic device, such as a light, speaker, camera, sensor system, or any other suitable electronic device.

Any of the electronic devices insertable into the aperture could include controls on the insert itself, or could be configured to communicate with an external device, such as a smartphone, tablet, or computer, which could be used to modify the characteristics of the electronic devices, control the operation of the electronic devices, or power the electronic devices on or off. An insert including an electronic device may include a wireless communication module configured to allow communication with an external device.

An insert including an electronic device may include a power source. In some embodiments, a device may include an integrated power source, such as a rechargeable battery. In some embodiments, a device may be configured to receive a removable battery or other suitable power source.

A light or series of lights can create a variety of visual effects, such as a glow, headlight, or safety warning. In some embodiments, one or more lights may be used as a safety feature to increase visibility of a rider at night. In some embodiments, a lower surface of the insert may include a downlight configured to illuminate the ground underlying the caster board. In some embodiments, light may be emitted in any desired direction. Such a light may be monochrome or multicolor, and may in some embodiments a user may control the operation of the light vary the color, brightness, illumination pattern or rate, or other characteristic of the emitted light.

A speaker or speakers can create a variety of audible effects, such as music, sound effects, or alarms. A speaker may include internal storage configured to store music, such as a removable or integrated memory, memory card, or other storage medium, so that no connection with an external device is required to play music. In some embodiments, a wireless connection may be made with an external device such as a smartphone to stream or transmit an audio signal or audio file to a speaker insert for playback.

A camera or series of cameras can be used to capture image data such as photographs or videos, including while riding the caster board. The camera may be configured to use an interchangeable lens and/or filter to vary a characteristic of the captured image or video data. The captured image or video data may be saved to a local memory within the insert, or may be transmitted or streamed to an external device.

In some embodiments, the insert may include one or more sensors or sensor systems. Examples of sensors which could be included in an insert include: an accelerometer, GPS tracker, or other measurement or navigation device. Sensors and sensor systems can be used to measure, record, or display a variety of measurements or physical characteristics, such as time, velocity, or location. Sensor systems can also be used to locate the caster board, including when the caster board is lost, stolen, or misplaced. Embodiments of sensors or sensor systems can be configured to communicate with an external device, to provide sensor output and/or to control the operation of the sensors.

In some embodiments, a locking mechanism may be used to securely retain an insert in place, and to inhibit or prevent its removal, particularly when the insert may include GPS or other location sensors which can provide an indication of the location of the caster board as a security feature.

In some embodiments, the insert may not itself comprise an electronic device, but may instead comprise a mounting system for a separate device, such as an external phone, camera, speaker, or other device. The separate mounted device can be used to record video, take photographs, play audio, or perform other functions while riding the caster board.

A separate mounted device may be retained within the aperture, or may utilize the aperture to securely retain the separate device at a desired position relative to the caster board. For example, a camera mount may allow an offset mounting of a camera or other recording device at the edge of the caster board or at a distance from the caster board, which may provide a more suitable angle for recording video, images, and/or audio. The mounting system can be used to store or secure a phone, camera, speaker, or other device while riding the caster board.

In some variants, the caster board can stow a mobile electronic device, such as a cellphone. For example, in some embodiments, the aperture is configured to removably receive and securely retain the mobile electronic device. In certain variants, the insert comprises a chamber that is configured to removably receive and securely retain the mobile electronic device. A friction fit and/or one or more locking members (e.g., straps, elastic bands, clasps, detents, etc.) can hold the mobile electronic device in position.

In some embodiments, the neck can include a performance accessory such as a groove, tube, or other surface for grinding. Grinding refers to a maneuver where a caster board rider slides the caster board along another surface, such as the edge of a ramp, box, ledge, or pole. Grinding can wear or damage a caster board. Adding a groove, tube, or other grinding surface to the neck can make it easier for caster board riders to perform a grinding maneuver and can increase the durability of a caster board while grinding.

Because certain embodiments described herein may utilize a neck region, such as the illustrated split neck regions, as the primary torsion element, there may be no need to include a separate torsion bar underlying and connecting the front platform section to the rear platform section. Because of the lack of a torsion bar, a centrally located aperture which is aligned with a longitudinal axis of the caster board may expose a space underlying the caster board platform which would otherwise be occupied by a torsion bar.

Certain inserts may occupy or otherwise make use of this open space. For example, in an embodiment in which the insert includes a downlight, the lack of an underlying torsion bar may allow more effective illumination of the area underlying the aperture. In an embodiment in which the insert includes a performance accessory, the additional space provided by the lack of an underlying torsion bar may give greater flexibility as to the type and size of performance accessories which may be used.

In some embodiments, a storage compartment can be added to the aperture or secured relative to the caster board using the aperture. The storage space can be used to store or secure a variety of items within the caster board, such as keys, a wallet, or an identification card. Items can be stored or secured in the storage space while riding or transporting the caster board. In some embodiments, a storage compartment may be secured in place using the aperture but may, for example, occupy a portion of the area underlying the aperture to provide additional storage space which may be larger or of a different shape than the aperture itself.

In some embodiments, a block or locking mechanism can be added to the gap. The block or locking mechanism can inhibit or prevent the caster board platforms from pivoting relative to each other, which would inhibit or prevent a user from operating the caster board as normal. In some embodiments, the block or locking mechanism can be removed using a key, passcode, or other unlocking device. The block or locking mechanism may be removed via direct interaction with the block or locking mechanism, or by indirect interaction with the block or locking mechanism via an external device such as a phone or tabled. The block or locking mechanism can function as an anti-theft device that could inhibit or prevent an individual from stealing and riding another individual's caster board without permission. The block or locking mechanism can be configured to stabilize the caster board when not in use, such as when shipping or transporting the caster board.

In some embodiments, a magnet or magnetic surface can be affixed to the neck, or added to the gap, using an attachment mechanism. A magnet or magnetic surface can be used to secure the caster board when attaching the caster board to a magnetic wall mount. A magnet or magnetic surface can also be used to affix magnets or other items to the caster board for either aesthetic or functional purposes.

In some embodiments, a spark generating device or structure can be added to the neck. A spark generating device can include spark pads or a spark plate made from flint or another material that generates sparks when in contact with a surface such as cement, asphalt, or metal. The spark generating device can be added to the neck using an adhesive or other attachment mechanism. Sparks can be desirable because they may create an appealing visual or audible effect.

In some embodiments, an insert may itself include an aperture extending at least partially therethrough. For example, in some embodiments, an insert having an outer dimension specific to the caster board may be used as an adapter to define a smaller aperture more suitable for retaining at least a portion of another device or structure. In such an embodiment, an adapter insert may be used to allow securement of another device or mechanism relative to the caster board, such as an existing consumer electronics device, which was not explicitly designed for use with a given caster board.

Figure 14:
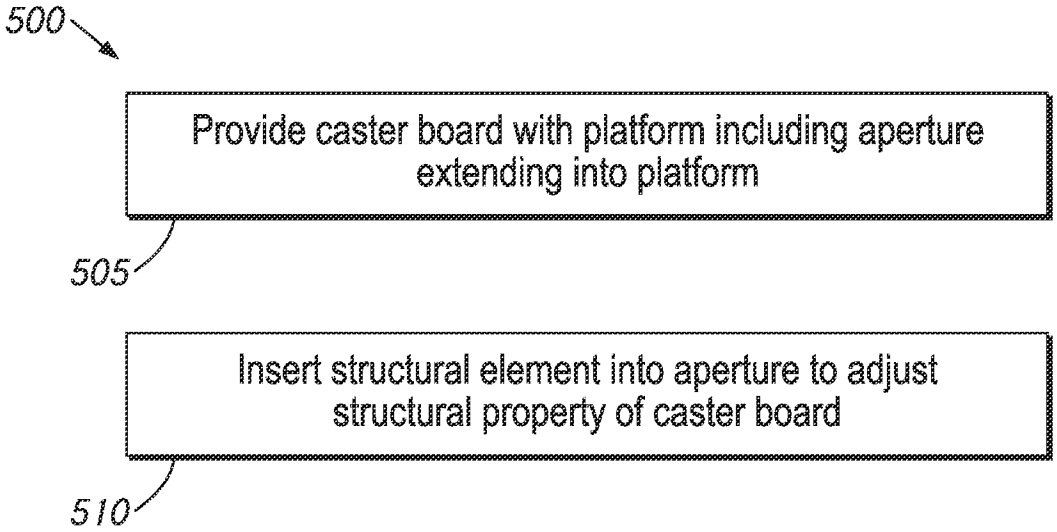
FIG. 14 is a flow diagram illustrating an exemplary process for modifying a structural property of a caster board using an insert.

FIG. 14 is a flow diagram illustrating an exemplary process for modifying a structural property of a caster board using an insert. The process 500 begins at a stage 505 where a caster board is provided, the caster board including an aperture extending into the platform. In some embodiments, the aperture may extend completely through the platform. In some embodiments, the aperture may extend through only a portion of the platform. In some embodiments, the aperture may include a chamfered section, or a section which is otherwise tapered or dimensioned to receive an insert. In some embodiments, the aperture may be longitudinally asymmetrical, with a width that varies over the longitudinal length of the aperture.

The process 500 then moves to a stage 510 where a structural element is inserted into the aperture to adjust a structural property of the caster board. In some embodiments, the structural element may include an insert configured to adjust a torsional stiffness of the caster board. In some embodiments, the structural element may be configured to adjust the mass of a portion of the caster board, or a distribution of mass across a caster board. In other processes, any other type of insert, such as an insert including an electronic device, may be inserted into the aperture.

The present disclosure includes ornamental aspects of the caster boards and such ornamental aspects may be claimed. Some such claims encompass only part of the disclosed caster boards. For example, the caster wheels, fasteners, parting and/or sculpting lines, ribs (e.g., the ribs 152, 154), and/or recesses (e.g., the depressions 176*a*, 176*b*) and features therein may be disclaimed. In some embodiments, the ornamental features shown in FIG. 3 (less, e.g., depressions 176*a*, 176*b* and features therein) are claimed.

While certain embodiments have been described, these embodiments have been presented by way of example only and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope of the disclosure.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Certain terminology may be used in the following description for the purpose of reference only, and thus is not intended to be limiting. For example, terms such as "upper", "lower", "upward", "downward", "above", "below", "top", "bottom", "left", and similar terms refer to directions in the drawings to which reference is made. Such terminology may include the words specifically mentioned above, derivatives thereof, and words of similar import. Similarly, the terms "first", "second", and other such numerical terms referring to structures neither imply a sequence or order unless clearly indicated by the context.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "spherical" or "circular" or "cylindrical" or "semi-circular" or "semi-cylindrical" or any related or similar terms, are not required to conform strictly to the mathematical definitions of spheres, circles, cylinders or other structures, but can encompass structures that are reasonably close approximations.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees. As another example, in certain embodiments, as the context may permit, the term "generally perpendicular" can refer to something that departs from exactly perpendicular by less than or equal to 20 degrees.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Some embodiments have been described in connection with the accompanying drawings. The figures are drawn to scale, but such scale is not limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Although the invention has been disclosed in the context of certain embodiments and examples, it will be understood by those skilled in the art that this disclosure extends beyond the specifically disclosed embodiments to other alternative embodiments and/or uses of the embodiments and certain modifications and equivalents thereof. The scope of the present disclosure is not intended to be limited by the specific disclosures of preferred embodiments in this section or elsewhere in this specification, and may be defined by claims as presented in this section or elsewhere in this specification or as presented in the future.

What is claimed is:

1. A caster board assembly comprising:

a caster board comprising a front end, a rear end, and a neck between the front end and the rear end, the neck comprising a gap, the gap comprising a chamfered section adjacent an upper surface of the caster board; and an insert configured to be removably positioned in the gap.

2. The caster board assembly of claim 1, wherein the insert is configured to modify a structural property of the caster board.

3. The caster board assembly of claim 2, wherein the insert is configured to alter the torsional stiffness of the caster board.

4. The caster board assembly of claim 2, wherein the insert is configured to add mass to the caster board.

5. The caster board assembly of claim 1, wherein the gap comprises a through-hole extending through the neck.

6. The caster board assembly of claim 1, wherein the gap comprises a blind hole extending partway through the neck.

7. The caster board assembly of claim 1, wherein the insert comprises an electronic device.

8. A caster board, comprising:

a platform, comprising:

a front platform section;

a rear platform section; and a first neck section extending between the front platform section and the rear platform section and comprising a first generally planar interior sidewall; and a second neck section extending between the front platform section and the rear platform section, the first neck section extending at an oblique angle to the second neck section, the second neck section comprising a second generally planar interior sidewall that faces and is oriented at an oblique angle to the first interior sidewall of the first neck section;

a first caster assembly connected to the first platform section; and a second caster assembly connected to the second platform section.

9. The caster board of claim 8, wherein the oblique angle is at least 2°.

10. The caster board of claim 8, additionally comprising an aperture extending through at least a portion of the platform, the aperture located between the first neck section and the second neck section.

11. The caster board of claim 10, wherein the aperture is longitudinally asymmetric.

12. The caster board of claim 8, wherein the first and second neck sections are located on opposite sides of a longitudinal axis of the caster board.

13. The caster board of claim 12, wherein the platform is configured to twist about the longitudinal axis of the caster board, and wherein a torsional stiffness of the first and second neck sections is less than a torsional stiffness of the front platform section and less than a torsional stiffness of the rear platform section.

14. The caster board of claim 8, further comprising:

a gap located between the first and second neck sections; and an insert that is configured to be removably installed in the gap, the insert comprising an electronic device.

15. A caster board, comprising:

a front platform section;

a rear platform section;

a longitudinally tapering neck section extending between the front platform section and the rear platform section, a portion of the longitudinally tapering neck section adjacent the front platform section being wider than a portion of the longitudinally tapering neck section adjacent the rear platform section; and an aperture extending through at least a portion of the longitudinally tapering neck section, a width of the aperture increasing with increasing distance from the rear platform section.

16. The caster board of claim 15, wherein the neck section comprises two substantially linear neck portions extending on either side of the aperture.

17. The caster board of claim 16, wherein the portions of the substantially linear neck portions extending adjacent the aperture have a substantially constant upper profile along their length.

18. The caster board of claim 15, further comprising an insert retained within the aperture.

19. The caster board of claim 18, wherein the aperture comprises a chamfered section and the insert comprises a flared cross-sectional shape.

* * * * *